US008262177B2

(12) United States Patent
Picken et al.

(10) Patent No.: US 8,262,177 B2
(45) Date of Patent: Sep. 11, 2012

(54) REFRIGERATOR SHELF ASSEMBLY

(75) Inventors: Alan D. Picken, Manitou Beach, MI (US); William Beckman, Holland, MI (US); David E. Nestell, Spring Lake, MI (US); R. Scott Repp, Holland, MI (US); Kevin J. Schroeder, Holland, MI (US)

(73) Assignees: Donnelly Corporation, Holland, MI (US); Clarion Technologies, Inc., Grand Rapids, MI (US)

( * ) Notice: Subject to any disclaimer, the term of this patent is extended or adjusted under 35 U.S.C. 154(b) by 810 days.

(21) Appl. No.: 11/577,147

(22) PCT Filed: Oct. 13, 2005

(86) PCT No.: PCT/US2005/036992

§ 371 (c)(1),
(2), (4) Date: Oct. 14, 2008

(87) PCT Pub. No.: WO2006/044641

PCT Pub. Date: Apr. 27, 2006

(65) Prior Publication Data

US 2009/0051257 A1 Feb. 26, 2009

Related U.S. Application Data

(60) Provisional application No. 60/619,087, filed on Oct. 15, 2004, provisional application No. 60/707,623, filed on Aug. 12, 2005.

(51) Int. Cl.
*A47B 96/02* (2006.01)

(52) U.S. Cl. ..... 312/408

(58) Field of Classification Search ..... 312/408, 312/404, 351, 401, 410; 211/126.15, 90.01, 211/90.04, 153, 193; 248/235, 250; 108/106–108, 108/147.17, 184; 62/465, 382
See application file for complete search history.

(56) References Cited

U.S. PATENT DOCUMENTS

| | | | | |
|---|---|---|---|---|
| 3,707,521 | A | 12/1972 | De Santis | |
| 4,191,437 | A | 3/1980 | Funke | |
| 4,735,470 | A * | 4/1988 | Falk | 312/246 |
| 4,736,997 | A * | 4/1988 | Besore et al. | 312/236 |
| 4,765,512 | A | 8/1988 | Bull, Jr. | |
| 4,934,541 | A | 6/1990 | Bussan et al. | |
| 5,228,764 | A | 7/1993 | Cherry et al. | |
| 5,297,486 | A | 3/1994 | Herrmann et al. | |
| 5,340,209 | A * | 8/1994 | Kolbe et al. | 312/408 |

(Continued)

OTHER PUBLICATIONS

Search Report and Written Opinion for corresponding PCT Application No. PCT/US2005/036992, filed on Oct. 13, 2005.

(Continued)

*Primary Examiner* — James O Hansen
*Assistant Examiner* — Sasha T Varghese
(74) *Attorney, Agent, or Firm* — Gardner, Linn, Burkhart & Florey, LLP

(57) ABSTRACT

A shelf assembly for use in a refrigerator includes a shelf panel and a pair of opposite support rails. The shelf panel has upwardly angled perimeter regions and may comprise a strengthened glass material, such as a transparent strengthened glass material, such as tempered glass. Each of the support rails includes a base portion and an angled portion that extends at an angle from the base portion. The angled portions of the support rails are bonded along the lower surface of the upwardly angled side perimeter regions of the shelf panel.

80 Claims, 14 Drawing Sheets

U.S. PATENT DOCUMENTS 5,362,145 A * 11/1994 Bird et al. ..... 312/408
5,396,997 A 3/1995 Johnson
5,403,084 A 4/1995 Kane et al.
5,437,165 A 8/1995 White et al.
5,454,638 A 10/1995 Bird et al.
5,516,204 A * 5/1996 Calvert et al. ..... 312/408
5,540,493 A 7/1996 Kane et al.
5,551,197 A 9/1996 Repp et al.
5,564,809 A 10/1996 Kane et al.
5,660,777 A 8/1997 Herrmann et al.
5,677,030 A * 10/1997 Shanok et al. ..... 428/122
5,704,173 A 1/1998 Repp et al.
5,705,113 A 1/1998 Kane et al.
5,706,737 A 1/1998 Whitehead et al.
5,735,589 A 4/1998 Herrmann et al.
5,738,880 A 4/1998 Kane et al.
5,799,866 A 9/1998 Hattem
5,813,741 A 9/1998 Fish et al.
5,853,895 A 12/1998 Lewno
5,944,324 A * 8/1999 Schultheis et al. ..... 277/637
5,947,574 A 9/1999 Avendano
5,966,874 A 10/1999 Repp et al.
6,068,719 A 5/2000 Lewno
6,100,209 A * 8/2000 Bentem et al. ..... 501/19
6,105,233 A * 8/2000 Neal ..... 29/451
6,113,206 A 9/2000 Melson et al.
6,120,720 A 9/2000 Meier et al.
6,128,860 A 10/2000 Repp et al.
6,227,636 B1 5/2001 Lye et al.
6,298,606 B1 10/2001 Repp et al.
6,319,344 B1 11/2001 Lewno
6,429,408 B2 8/2002 Muskalla et al.
6,488,347 B1 12/2002 Bienick
6,565,169 B1 5/2003 Moreno-Olguin et al.
6,588,326 B2 7/2003 Taplan et al.
6,604,800 B2 8/2003 Hamilton
6,679,573 B2 1/2004 Bienick
6,729,704 B2 5/2004 Ames
6,786,562 B2 9/2004 Obrock et al.
6,811,045 B1 * 11/2004 Masker et al. ..... 211/153
2003/0038571 A1 2/2003 Obrock et al.
2003/0151340 A1 * 8/2003 Mathur et al. ..... 312/408
2004/0036391 A1 * 2/2004 Vardon ..... 312/408
2004/0056575 A1 * 3/2004 Dietz et al. ..... 312/408
2005/0017143 A1 1/2005 Bronsink et al.
2006/0213849 A1 9/2006 Bienick

OTHER PUBLICATIONS

English summary of Official Action of corresponding Mexican Patent Application No. MX/a/2007/004477.

* cited by examiner

FIG. 11
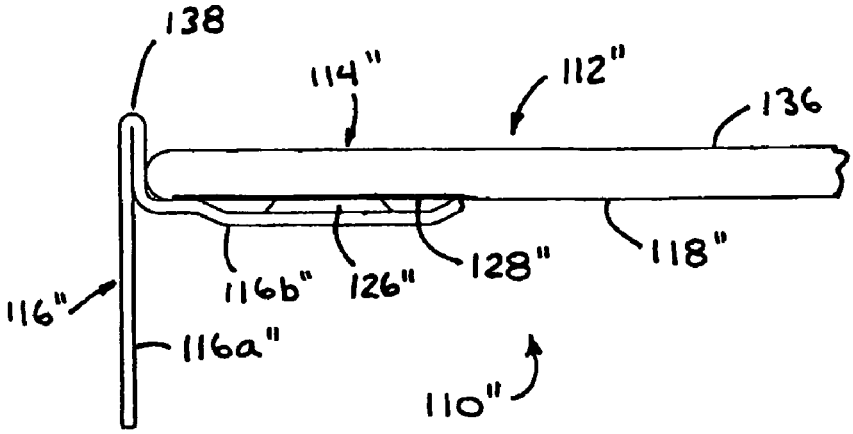
FIG. 13
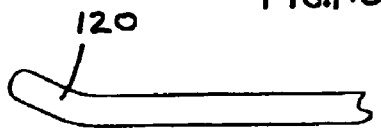
FIG. 14
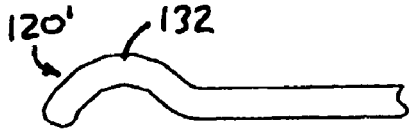
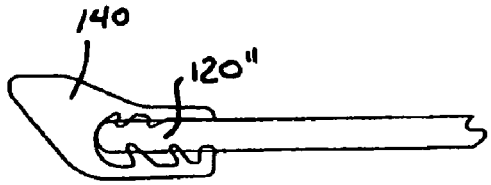
FIG. 15

REFRIGERATOR SHELF ASSEMBLY

CROSS REFERENCE TO RELATED APPLICATIONS

The present application claims benefit of U.S. provisional applications, Ser. No. 60/619,087, filed Oct. 15, 2004; and Ser. No. 60/707,623, filed Aug. 12, 2005, which are hereby incorporated herein by reference in their entireties.

FIELD OF THE INVENTION

The present invention relates to shelving and, more particularly, to glass shelving for refrigerators and the like.

BACKGROUND OF THE INVENTION

It is known to provide a substantially transparent glass shelf for a refrigerator, where the shelf is supported on a pair of supports extending at least partially along the side edges of the glass shelf. The supports receive the edges of the shelf along side caps or the like to retain the shelf to the supports and to provide a lip along the upper surface of the shelf to form a "spill proof" shelf. Such lips or caps may limit spillage over the edges of the shelves, but may interfere with the upper surface of the shelves and may not be aesthetically pleasing to look at. Examples of such shelves are described in U.S. Pat. Nos. 6,786,562; 6,113,206; 6,120,720; 5,228,764; 6,488,347; 6,679,573; 6,604,800; 4,934,541; and 6,729,704, which are hereby incorporated herein by reference.

SUMMARY OF THE INVENTION

The present invention provides a shelf assembly, such as a shelf assembly for a refrigerator, where a lower surface of the shelf panel is bonded to a support or rail or slide or roller mechanism extending along each side region of the shelf panel. The shelf panel may have curved or turned or bent edge regions along the support (and optionally along the front and/or rear edges or regions of the shelf panel) to provide a spill proof shelf without end caps or the like along the edges of the shelf panel. The glass shelf panel may include a frit layer or the like along the lower surface of the panel and along the bonded region to provide an enhanced appearance to the shelf assembly.

According to an aspect of the present invention, a shelf assembly for use in a refrigerator includes a shelf panel and at least one support rail or slide or roller mechanism. The shelf panel has a lower surface and comprises a substantially transparent glass material. The support rail is bonded along the lower surface of the shelf panel.

The shelf assembly may include a frit layer along the lower surface of the shelf panel, and the support rail may be bonded to the frit layer. Optionally, a frit layer or concealing or substantially non-transparent layer may be provided along the upper surface of the shelf panel and generally at and above the region of the shelf panel where the support rail is located. The support rail may include a generally horizontal support portion that is bonded to the lower surface of the shelf panel, and the generally horizontal support portion may comprise a curved portion.

The shelf panel may have at least one perimeter region that is curved, such as upwardly and/or downwardly curved depending on the particular application of the shelf assembly. The shelf panel may comprise a substantially transparent strengthened or toughened or tempered glass material. The opposite side regions of the shelf panel may be curved, and the support rail may bond to the shelf panel along each of the curved side regions of the shelf panel. Optionally, a front region of the shelf panel may also be curved, and/or a rear region of the shelf panel may also be curved.

According to another aspect of the present invention, a shelf assembly for use in a refrigerator includes a shelf panel comprising a glass material and a pair of opposite support rails. The shelf panel comprises a generally planar shelf portion, a front perimeter region, a rear perimeter region and opposite side perimeter regions. The front perimeter region, the rear perimeter region and the perimeter side regions are upwardly angled along respective perimeter regions of the generally planar portion of the shelf panel. The upwardly angled side perimeter regions and the upwardly angled front and rear perimeter regions cooperate to provide a substantially continuous upwardly angled perimeter lip around the perimeter regions of the generally planar shelf portion. The side perimeter regions have an upwardly angled lower attachment surface. Each of the support rails have a generally vertical portion and an angled portion that extends at an angle from an upper edge region of the generally vertical portion, which is at a generally vertical orientation when mounted in a refrigerator. The angled portions of the support rails are angled to generally correspond to the angle of the upwardly angled side perimeter regions of the shelf panel. The angled portions of the support rails are bonded along a respective one of the lower attachment surfaces of the side perimeter regions of the shelf panel via a cured adhesive layer.

Optionally, the angled portions of the support rails may include generally planar portions and may be angled to generally correspond to the angle of the upwardly angled side perimeter regions of the shelf panel. The generally planar portions of the angled portions of the support rails may be bonded along a respective one of the lower attachment surfaces of the side perimeter regions of the shelf panel via the cured adhesive layer. Optionally, the shelf panel may be substantially transparent and the cured adhesive layer may be substantially optically matched with the optical index of the shelf panel glass material.

Therefore, the present invention provides a substantially transparent strengthened glass shelf panel, such as a tempered glass (such as thermally tempered glass or chemically tempered glass) or toughened glass shelf panel or the like, that is bonded along its lower surface and along the side regions of the panel to a pair of side shelf support rails so as to avoid interference or intrusion of the rails onto the upper surface of the shelf panel. The shelf panel may be formed to have curvatures along one or more of the side or front or rear perimeter portions or regions, in order to provide the desired appearance and function, such as a spill proof function or handle function or the like, to the shelf panel. The shelf panel may have a frit layer along its lower surface and in the bonding area along the shelf support rails to conceal the rails so that they are not readily discernible and viewable through the substantially transparent strengthened glass shelf panel.

These and other objects, advantages, purposes and features of the present invention will become apparent upon review of the following specification in conjunction with the drawings.

BRIEF DESCRIPTION OF THE DRAWINGS

FIG. 11 is a sectional view similar to FIG. 9, showing another shelf assembly having a support bracket with a spill proof lip in accordance with the present invention;

FIG. 13 is a sectional view of the front portion of the shelf panel taken along the line XIII-XIII in FIG. 8;

FIG. 14 is a sectional view similar to FIG. 13, showing another shelf panel of the present invention;

FIG. 15 is a sectional view similar to FIG. 13, showing another shelf panel of the present invention, with an extruded channel member along the front edge of the shelf panel;

DESCRIPTION OF THE PREFERRED EMBODIMENTS

Figure 1:
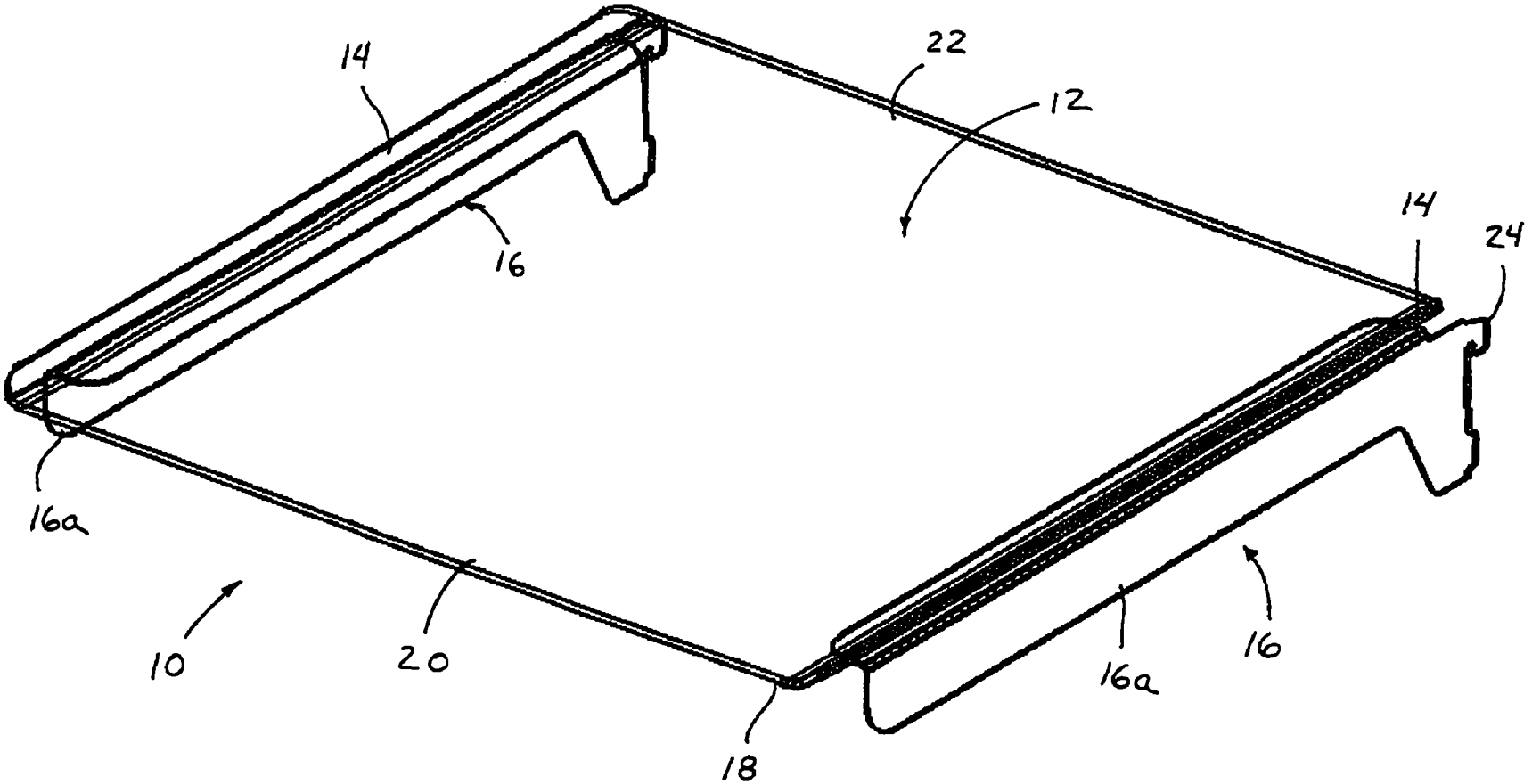
FIG. 1 is a perspective view of a refrigerator shelf assembly in accordance with the present invention, with the side regions turned or curved upwardly along the sides of the shelf panel.
Figure 2:
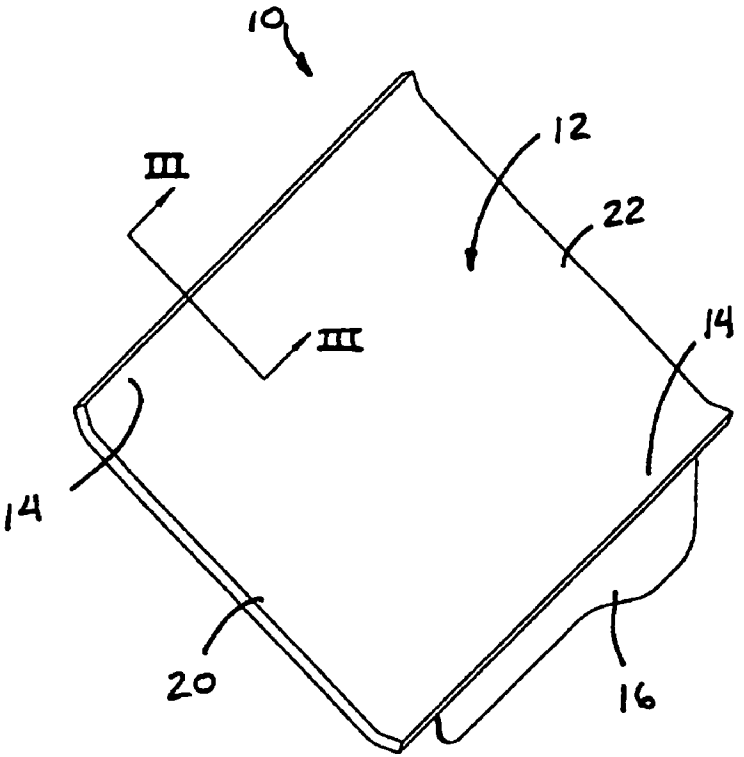
FIG. 2 is another perspective view of the refrigerator shelf assembly of FIG. 1.

Referring now to the drawings and the illustrative embodiments depicted therein, a shelf assembly 10 includes a substantially transparent shelf panel 12 that is supported at least partially along its side regions or edges 14 by respective supports or support brackets or rails 16 (FIGS. 1 and 2). The support brackets 16 are attachable or mountable to a support structure (not shown), such as to a support rack or the like within a refrigerator. The underside or lower surface 18 of shelf panel 12 is bonded to the support brackets 16, such that the support brackets are secured to the lower surface of the shelf panel and thus do not extend over or intrude onto the upper surface of the shelf panel 12. The perimeter side regions or edges 14 and/or the front edge or region 20 and/or the rear edge or region 22 of the shelf panel may be curved or bent to provide a spill proof shelf, as discussed in detail below. Although shown and described as a shelf panel assembly for a refrigerator, the shelf panel assembly of the present invention is intended for use in other types of cabinets or coolers or the like, and the term "refrigerator" is intended to include other food storage containers or cold storage containers or devices or cabinets or freezers or the like, without affecting the scope of the present invention.

Shelf panel 12 may comprise a glass panel, and preferably a substantially transparent strengthened glass panel, such as a tempered or toughened glass panel, suitable for use in a refrigerator environment. The glass panel may be cut to the desired size and shape for the shelf and may be formed to have the desired curvature along the peripheral edges or perimeter regions of the shelf. For example, the shelf panel may be pressed to bend or turn or curve the perimeter regions to the desired shape. In the illustrated embodiment, of FIGS. 1-3, the panel is press bent or pressed against a form so as to form generally upwardly turned side regions 14 to limit or substantially preclude spillage of liquids over the sides of the shelf. For example, the shelf panel may be pressed upward against a substantially flat form (with curved side or perimeter edges) while the glass shelf panel is heated, whereby the side edge portions of the shelf panel are bent at the perimeter edges of the form. The shelf panel may then be lowered away from the form and cooled or quenched to form the shelf panel. The formed shelf panel may be substantially planar or flat between the curved side edge portions or regions. Other forms may be implemented (as discussed below) to provide the desired function and appearance of the shelf panel, without affecting the scope of the present invention.

Figure 3:
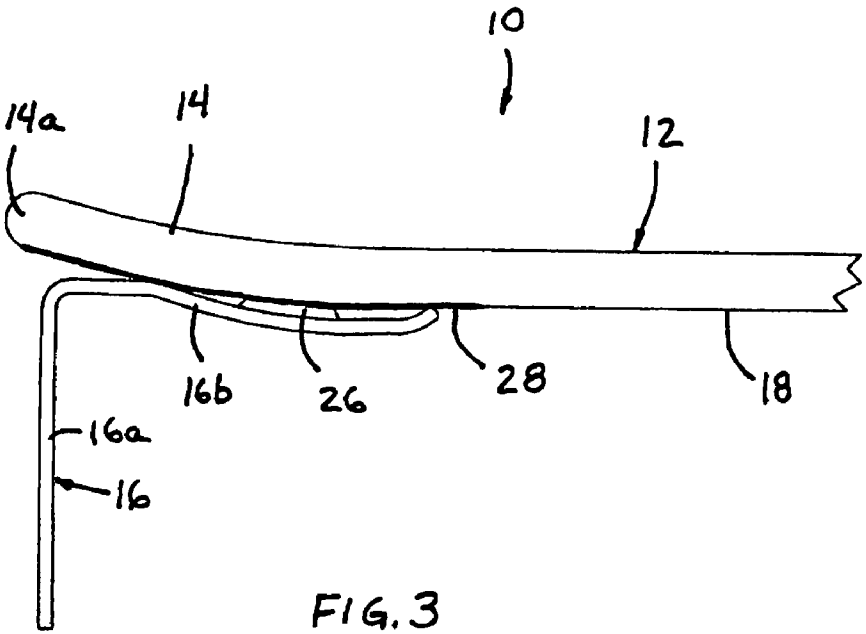
FIG. 3 is a sectional view of the shelf assembly taken along the line III-III in FIG. 2.

As shown in FIGS. 1 and 3, each support bracket 16 includes a generally vertical portion 16*a* that may include tabs 24 or the like at a rearward end of the bracket for mounting the support bracket and shelf assembly within the refrigerator, such as in a manner known in the art. As shown in FIG. 3, each support bracket 16 includes a generally horizontal support portion 16*b* that extends generally horizontally from an upper end of the vertical portion 16*a*. The support portion 16*b* may be curved to receive an adhesive bonding material therealong (as discussed below) and/or to generally correspond to the curvature of the side regions 14 of panel 12 (as also discussed below).

The side regions 14 of shelf panel 12 thus may rest on the support portions 16*b* of the brackets 16 when the shelf panel is attached to the support brackets 16. As shown in FIG. 3, the lower surface 18 of the shelf panel along the side regions 14 may be bonded to the generally horizontal support portion 16*b* of support brackets 16, such as via curing of a bonding or adhesive material 26 and utilizing bonding processes of the types described in U.S. Pat. Nos. 6,298,606; 6,128,860; 5,966,874; 5,704,173; and 5,551,197, which are hereby incorporated herein by reference. In the illustrated embodiment, the shelf panel 12 includes a frit layer 28 along the lower surface 18 and along the side regions 14 of the shelf panel to substantially conceal the support brackets or rails along the side regions so that the brackets or rails are not readily viewable through the shelf panel from above the shelf panel. Optionally, however, the shelf panel may not include a frit layer, and the rail or support may be bonded directly to the lower surface of the shelf panel, such as via a UV cured adhesive or the other type of cured adhesive or bonding adhesive or the like, without affecting the scope of the present invention. In such an application, the supports or rails or slide mechanisms may be viewable through the shelf panel.

The bonding adhesive 26 may be selected from a number of adhesive types or classes including moisture-activated urethanes, such as described in U.S. Pat. No. 3,707,521, which is hereby incorporated herein by reference, moisture-activated silicones, moisture-curable activated urethanes, chemically-activated adhesives, and thermally-activated adhesives, and/or the like. Other adhesives, such as aerobically-cured, anaerobically-cured, and radiation-cured adhesives can also be used, without affecting the scope of the present invention. When cured, the bond-line thickness may be in the range of about 1 micron to 10 mm, preferably about 5 microns to 5 mm, and most preferably about 25 microns to 1 mm. The adhesive may be a moisture-activated adhesive, a chemically activated adhesive, a heat or radiation or ultraviolet or microwave radiation activated adhesive or the like, and the shelf panel and brackets or rails may be exposed to the appropriate conditions or elements or radiation to cure the adhesive and bond the shelf panel to the brackets or rails, such as described in U.S. Pat. Nos. 6,298,606; 6,128,860; 5,966,874; 5,704,173; and 5,551,197; and 5,331,784, which are hereby incorporated herein by reference.

Optionally, a temporary fixturing adhesive (not shown) may also be provided, such as a hot-melt thermoplastic, which temporarily locates or fixtures the bracket or rail against the panel or frit layer, while the bonding adhesive 26 cures and forms the permanent primary bond. The temporary fixturing adhesive may secure or hold the brackets to the shelf panel until the bonding process is complete and the bonding adhesive has cured and formed the permanent bond. Optionally, to improve and promote the bonding characteristics of the bonding adhesive, the glass surface (or frit layer if applicable), and/or the rail or bracket portion 16*a*, may be coated with an adhesion-promoting compound or primer, such as described in U.S. Pat. Nos. 6,298,606; 6,128,860; 5,966,874; 5,704,173; and 5,551,197, which are hereby incorporated herein by reference.

Optionally, and as shown in the illustrated embodiment, the glass panel may include a frit layer 28 disposed along the side regions of the shelf panel and in the areas or regions at which the brackets are bonded. Optionally, the frit layer may comprise a ceramic frit layer and may function to facilitate adhering or bonding of the edge regions of the shelf panel to the rails. The frit layer is preferably substantially opaque, and thus may improve the overall appearance of the shelf, since the bonding surfaces are not readily discernible or viewable through the shelf panel and the frit layers. Examples of such frit layers are described in U.S. Pat. Nos. 6,298,606; 6,128,860; 5,966,874; 5,704,173; and 5,551,197, which are hereby incorporated herein by reference. The frit layer may comprise a black or substantially opaque layer, or may comprise a white layer or other color as desired, such as to match a color scheme of the refrigerator. The frit layer may be disposed onto the lower surface 18 of the shelf panel in any desired pattern, such as stripes, dots, wave pattern or the like, to provide the desired appearance to the refrigerator shelf, depending on the particular application of the shelf assembly.

Optionally, the frit layer may be disposed or deposited on and bonded to the lower surface 18 of shelf panel 12 as an opaque frit layer, and most preferably, an opaque ceramic frit layer or coating covering and concealing a region of the surface 18 from a peripheral edge 14*a* inward. Shelf panel 12, which may be initially in an unstrengthened or untempered condition after cutting and sizing to its desired shape, can be painted, such as by screen coating or other techniques, with a coating of ceramic paint on its lower surface 18. Thereafter, shelf panel 12 may be heated and bent or pressed to the desired contour with a bending furnace or other bending apparatus, followed by strengthening, such as tempering, to strengthen the glass. Such heating, bending and tempering operations cause the ceramic paint to become fused to the lower surface of the shelf panel. Thus, although starting as a layer of paint containing ceramic particles and pigment, the coating ends up as a thin frit layer of ceramic material, which is fused to the lower surface of the glass shelf panel. Since the ceramic frit coating includes a pigment of a desired color, the layer results in a permanent, second or lower surface coloration of the glass shelf panel. However, and as discussed above, the rails or supports may be bonded to the lower surface of the shelf panel without any frit layer on the shelf surface, without affecting the scope of the present invention.

The refrigerator shelf of the present invention thus provides a substantially transparent or clear shelf panel (such as a strengthened or tempered glass panel) that is mounted to or bonded to support brackets or rails with no caps or lips extending over the perimeter edges and onto the upper surface of the shelf panel. The shelf panel may be formed to have a desired raised shape or lip along one or more of the perimeter edges or regions to limit spillage of liquids over the formed or curved perimeter region or regions. The present invention thus provides a strengthened or tempered glass shelf that is bonded to the support brackets and that has upwardly turned or curved perimeter edge regions. Optionally, and desirably, the mounting or bonding portions of the supports or brackets may have bumps or raised portions or dimples or protrusions spaced along the generally horizontal portion of the supports to set the desired or appropriate bond gap or bond layer thickness between the shelf panel surface and the mating surface of the supports or rails or brackets.

Preferably, the shelf panel of the present invention comprises a substantially clear or transparent panel and the bracket comprises a polished or finished metal bracket (such as a painted or coated bracket or a brushed aluminum bracket or a brushed or polished stainless steel bracket or the like). Such a substantially clear shelf panel is often desired for various refrigerator applications or other food storage containers or cabinets or freezers or the like. The brackets and shelf panel of the present invention may be attached or secured or bonded together via a curable adhesive bonding material, and the curable adhesive bonding material may be selected to be substantially transparent or clear and, preferably, may be index matched or substantially index matched to the glass material (which may have an optical index of approximately 1.45 to approximately 1.55, more preferably about 1.48 to about 1.53, and more preferably about 1.5 to about 1.52) and may have few to no bubbles or other noticeable imperfections. Thus, a person viewing through the shelf panel from above may principally see or view the bracket and the mounting portion of the bracket under the shelf and not the adhesive or any other materials or components of the shelf assembly. Optionally, the mounting surfaces or portions of the brackets may be textured or finished or otherwise formed/processed so as to be aesthetically pleasing or cosmetically attractive for viewing through the shelf panel and the adhesive bonding layer. Optionally, spacers or beads or the like may be positioned along the bond line to space the shelf panel the appropriate or desired amount above the mounting portion of the brackets, so as to provide a desired bond layer thickness between the mounting portions and the shelf panel. Optionally, and desirably, such spacers or beads may also be optically index matched with the adhesive material and/or the glass panel material.

Figure 4:
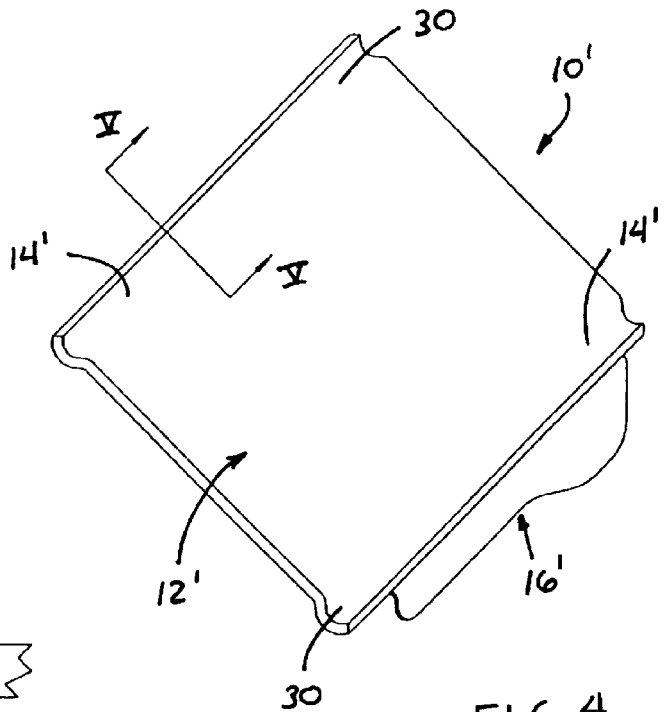
FIG. 4 is a perspective view of another refrigerator shelf assembly of the present invention, with the side regions turned or curved to form a gutter along the sides of the shelf panel.
Figure 5:
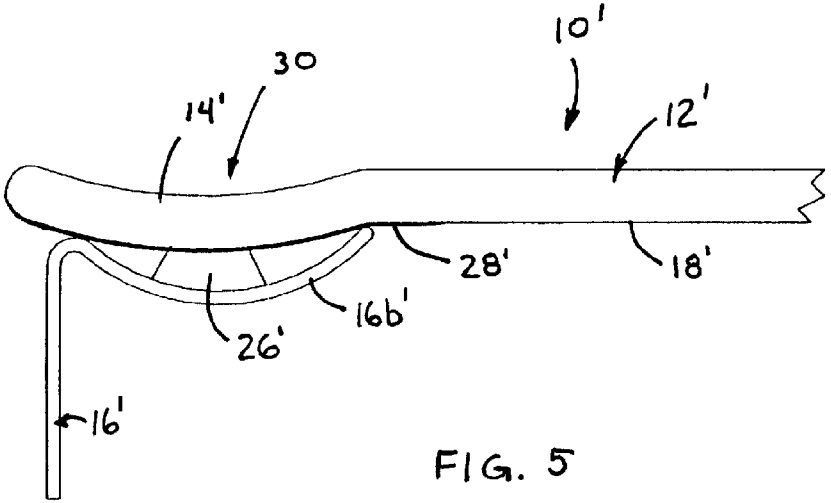
FIG. 5 is a sectional view of the shelf assembly taken along the line V-V in FIG. 4.

Optionally, the perimeter regions of the shelf panel may be formed to have other shapes, without affecting the scope of the present invention. For example, a refrigerator shelf assembly 10' (FIGS. 4 and 5) may include a shelf panel 12' that is pressed or formed or curved to have a channel or trough 30 along the perimeter side edges or regions 14'. As shown in FIG. 5, the shelf support or rail 16' may include a curved generally horizontal portion 16*b'* that is curved to form a channel that generally corresponds to the shape of the side regions 14' of the shelf panel 12'. The shelf panel may be bonded to the shelf brackets via a bonding material 26', and the lower surface 18' of shelf panel 12' may include a frit layer 28' along the side regions 14', in a similar manner as described above.

Figure 6:
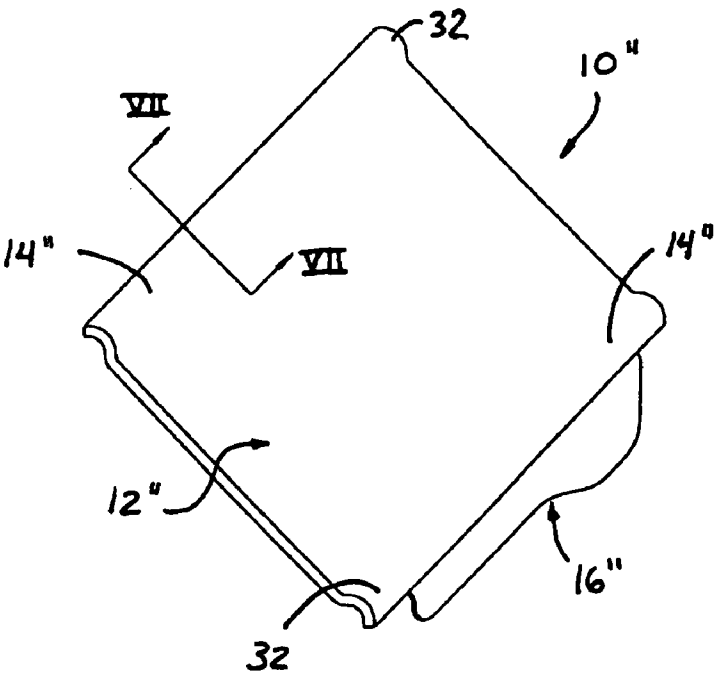
FIG. 6 is a perspective view of another refrigerator shelf assembly of the present invention, with the side regions turned or curved to form a raised bump along the sides of the shelf panel.
Figure 7:
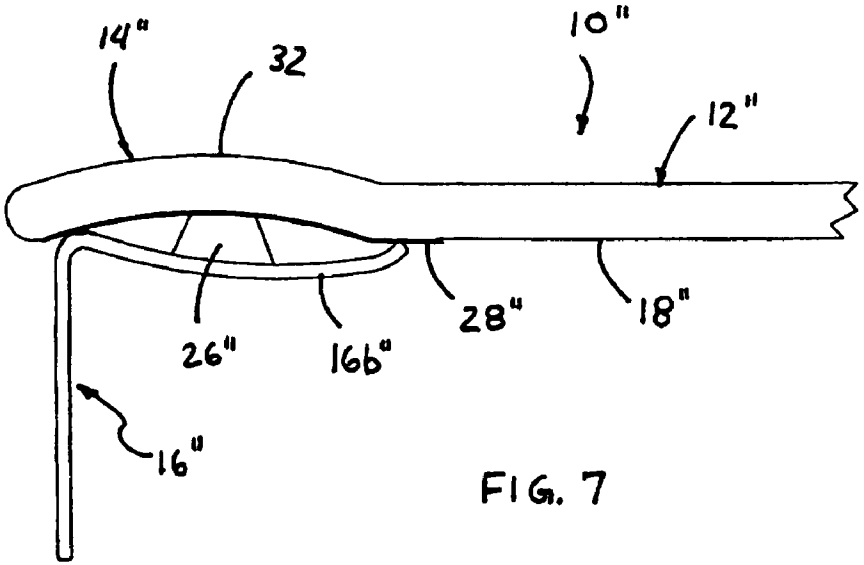
FIG. 7 is a sectional view of the shelf assembly taken along the line VII-VII in FIG. 6.

Similarly, and with reference to FIGS. 6 and 7, a refrigerator shelf assembly 10" may include a shelf panel 12" that has a raised bump 32 or reversed channel or trough formed along the perimeter side edges or regions 14". As shown in FIG. 7, the shelf support or bracket or rail 16" may include a curved generally horizontal portion 16*b"* that is curved to form a channel for receiving the bonding material 26" therealong to bond the panel to the support bracket. The lower surface 18" of shelf panel 12" may include a frit layer 28" along the side regions 14" in a similar manner as described above.

Figure 8:
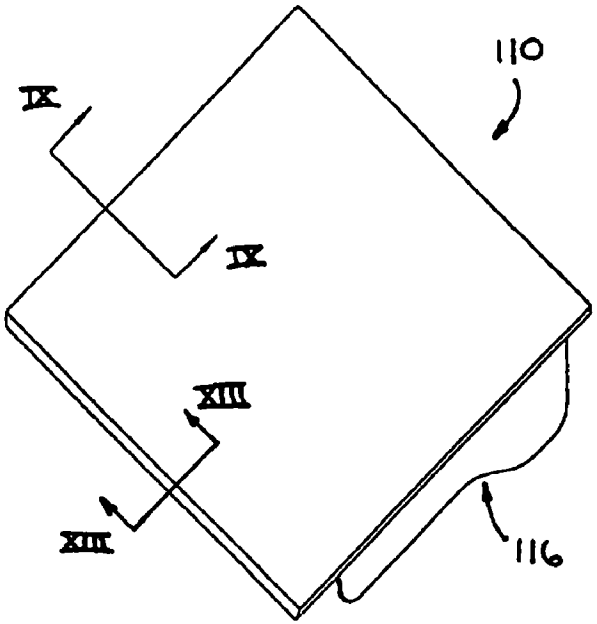
FIG. 8 is a perspective view of another refrigerator shelf assembly of the present invention, with a generally flat shelf panel.
Figure 9:
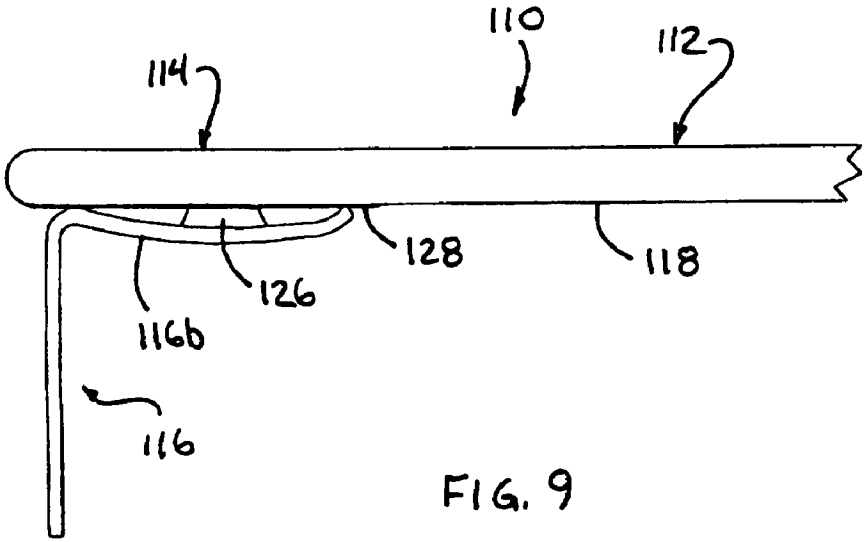
FIG. 9 is a sectional view of the shelf assembly taken along the line IX-IX in FIG. 8.

Optionally, and with reference to FIGS. 8 and 9, the refrigerator shelf assembly 110 may include a substantially flat shelf panel 112 that is supported on support brackets or rails 116. The perimeter side regions 114 may be bonded to a generally horizontal and partially curved support portion 116*b* of brackets 116 via a bonding material 126 in a similar manner as described above. The shelf panel 112 may include a frit layer 128 along the lower surface 118 and along the side regions 114, such as described above.

Figure 10:
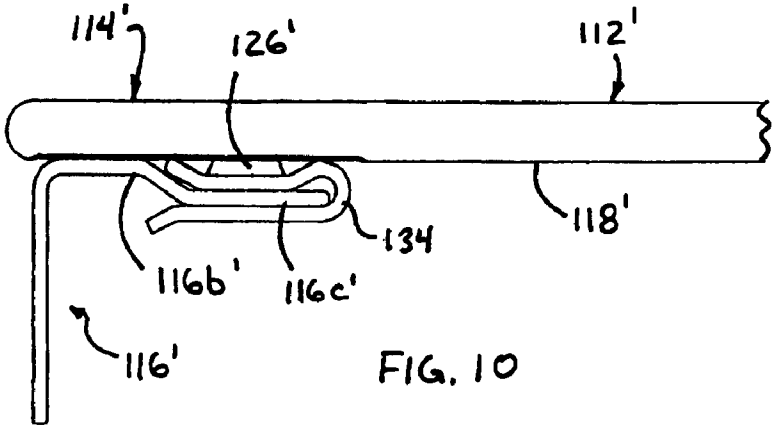
FIG. 10 is a sectional view similar to FIG. 9, showing a shelf panel bonded to a carrier in accordance with the present invention.

Optionally, and as shown in FIG. 10, the support bracket 116' may include a carrier member 134 that is bonded to the shelf panel 112' and that engages or attaches to or receives a portion of the generally horizontal support portions 116*b'* to secure the shelf panel 112' to the support brackets 116'. In the illustrated embodiment, the carrier member 134 is a generally C-shaped member extending along the lower surface and side regions of the shelf panel (when bonded thereto) and receives an edge or end 116*c'* of the horizontal portion 116*b'* of the support bracket 116'. The carrier member 134 may be bonded to the lower surface 118' of panel 112', and preferably to a frit layer 128' at the bonding area 126' along the edge portion 114' of the panel 112'. Such a carrier member may be suitable for use with any of the other shelf panels of the present invention, such as the upwardly curved or channel shaped shelf panels, without affecting the scope of the present invention.

Optionally, and with reference to FIG. 11, the support bracket or rail 116" of a shelf assembly 110" may include a generally vertical portion 116*a"* that extends upward above the generally horizontal portion 116*b"* and that extends or protrudes above the upper surface 136 of the shelf panel 112", in order to provide a lip 138 at least partially along the side edge of the shelf panel to provide a spill proof function to the refrigerator shelf assembly 110". The shelf panel 112" may be substantially flat or planar (as shown in FIG. 11) or may include generally flat side regions or edge portions 114" or curved or bent side regions or edge portions, without affecting the scope of the present invention. The lower surface 118" of the shelf panel 112" may include a frit layer 128" thereon and may be bonded (at bonding region 126") to the generally horizontal portion 116*b"* of the shelf support brackets 116", in a similar manner as described above.

Figure 12:
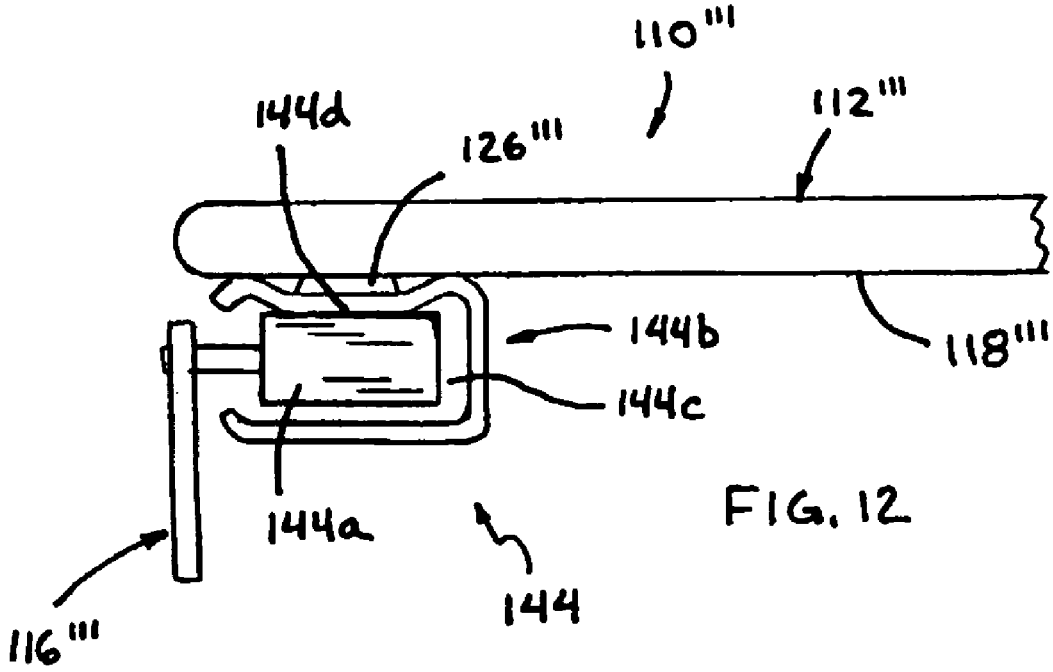
FIG. 12 is a sectional view similar to FIG. 9, showing another shelf assembly having a shelf panel bonded to a slide or roller mechanism.

Optionally, and as shown in FIG. 12, a shelf panel 112''' of a shelf assembly 110''' may be slidably or movably mounted to the support rails or brackets 116''' and may be movable along the support rails or brackets, such as via a slide mechanism or roller mechanism 144 or the like. For example, the support bracket or rail 116''' may include a roller or rollers 144*a* (such as two or more rollers spaced along the support bracket) that extend from the rail 116''' and rollingly engage or rotatably support a carrier or rail 144*b* of a shelf panel 112'''. The carrier 144*b* may be an elongated rail that defines a channel or track 144*c* for rotatably receiving the rollers 144*a*, such that an upper surface 144*d* of the channel or track 144*c* rests on the rollers 144*a* when the shelf panel is mounted to the support for rail or bracket 116'''. The carrier 144*b* may be bonded to the lower surface 118''' of shelf panel 112''' (and optionally may be bonded to a frit layer along the lower surface of the shelf panel), such as via a bonding adhesive 126'''. The shelf panel 112''' thus may be slidably or movably mounted to the support rail 116''' to facilitate movement of the shelf panel along the support rails or channels. Although shown as a roller and track mechanism, other moving or rolling or sliding means may be implemented to provide relative movement between the shelf panel and the generally fixed support that is mounted in the refrigerator, without affecting the scope of the present invention.

Optionally, the front and/or rear perimeter regions or edges of the shelf panel may be curved or formed to provide a spill proof function and/or to provide a handle or the like for a user to grasp to move the shelf, such as to lift the shelf to detach the support brackets or rails from the support within the refrigerator, such as to adjust a height or position of the shelf within the refrigerator. For example, and as shown in FIG. 13, the forward edge 120 of the shelf panel may be curved upwardly to provide a spill proof edge along the front of the shelf panel. Optionally, and with reference to FIG. 14, the forward edge 120' may be curved to form a bump 132 along the front edge of the shelf panel. Alternately, the forward edge 120" (FIG. 15) may be generally flat and may be received within and along an extruded member or lip 140 that may provide a handle function and/or a spill proof function along the front edge of the shelf panel. Other shapes or curvatures or forms may be implemented may be implemented without affecting the scope of the present invention.

Figure 16:
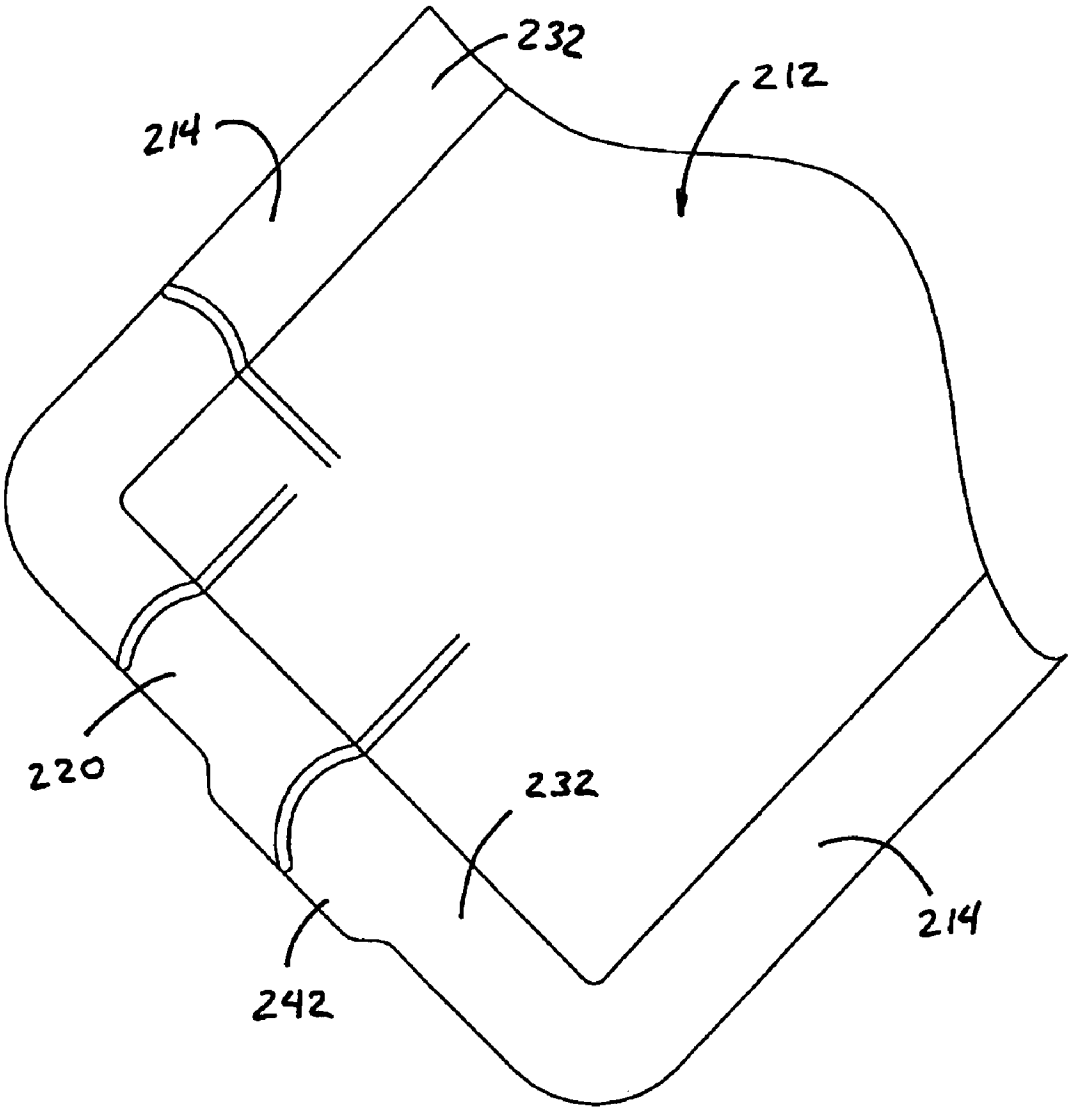
FIG. 16 is a perspective view of another shelf assembly in accordance with the present invention.

As shown in FIG. 16, a shelf panel 212 may have a bump or raised curvature 232 along the front edge portion 220 and along the side portions 214 (and optionally along the rear edge portion (not shown in FIG. 16) as well) to form a shelf panel that provides a spill proof function substantially or entirely around the perimeter of the shelf panel. The curved perimeter regions may be formed by pressing the strengthened or tempered or toughened glass panel or sheet against a desired form to bend the glass to the desired shape along one or more of its perimeter regions or edges. The panel may be cut or otherwise formed to have a handle portion 242 at a generally central region along the front edge portion 220. Optionally, it is envisioned that the front region may include a frit layer along at least a portion of the front of the shelf panel to enhance the appearance of the shelf and/or to make the handle portion readily viewable and discernible, depending on the application of the shelf assembly.

Figure 17:
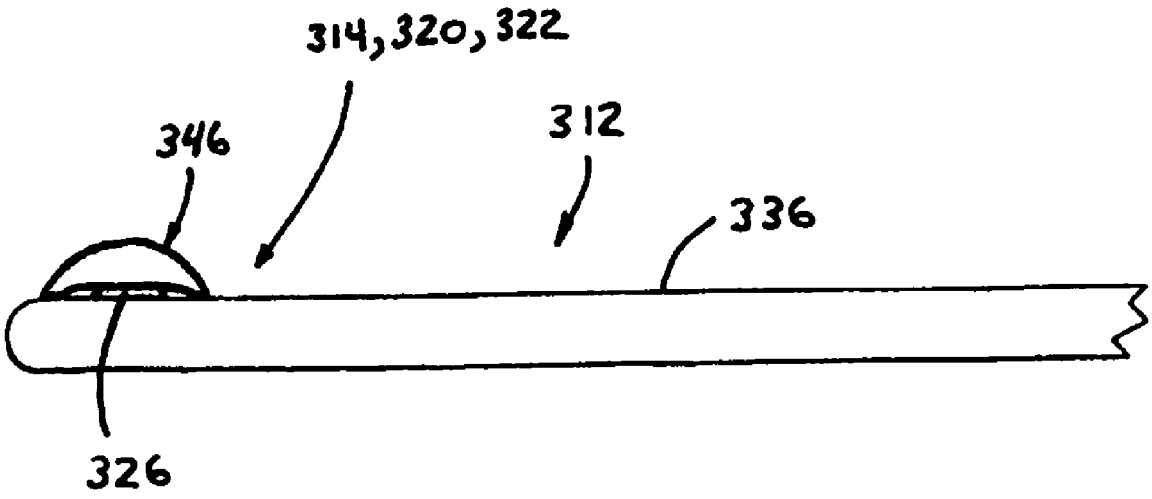
FIG. 17 is a sectional view of another shelf panel of the present invention, with a spill proof form bonded to the upper surface of the shelf panel.

Optionally, and with reference to FIG. 17, a shelf panel 312 may include an upper frame portion or form or guard 346 bonded to the upper surface 336 of shelf panel 312 and along one or more edge regions 314, 320, 322 of the shelf panel. The upper form 346 may be bonded to the upper surface 336, such as via a bonding adhesive 326, such as described above. The upper form or forms are thus bonded to the upper and often Class A finish surface (i.e. a surface readily viewable by a user of the refrigerator and thus required to be aesthetically and functionally acceptable) of the shelf panel. Optionally, the upper form or forms may be bonded to a frit layer at the upper surface of the shelf panel, without affecting the scope of the present invention. The upper form or forms may comprise a polymeric or plastic material or may comprise a metallic material or the like, without affecting the scope of the present invention. The upper form 346 provides a spill containment function to the otherwise generally flat surface of the shelf panel along the edge region or regions.

The upper form 346 may be bonded to the upper surface along the front and/or rear perimeter regions of the shelf panel, particularly for applications where the side regions of the shelf panel are turned upwardly or otherwise formed to provide a spill containment function. Alternately, or additionally, the form may be bonded to the upper surface along the side perimeter regions of the shelf panel, particularly for applications where the front and rear perimeter regions are upwardly turned or otherwise formed to provide a spill containment function. Optionally, an upper frame portion may comprise four sections unitarily formed or joined together and bonded to the upper surface of the shelf panel and along all four perimeter regions of the shelf panel to provide a spill containment function around the perimeter of the shelf panel.

Although shown in FIG. 17 as a curved or half-moon shaped form, the upper form or forms or frame may be any other shape or form, without affecting the scope of the present invention. It is further envisioned that the upper form or forms or frame may be shaped or molded or otherwise formed to provide other functions. For example, the form or forms may be shaped or molded or otherwise formed to provide a storage or holding function for holding or storing refrigerated items, such as bottles or cans or eggs or the like. For example, the form or forms may include generally cylindrical depressions or recesses for receiving bottles or cans, or may include depressions or recesses for holding or receiving other items, such as eggs or the like. The forms or frame thus may be larger than the form shown in FIG. 17, and may encroach further onto and over the upper surface of the shelf panel to provide for sufficient sized shapes or depressions or recesses or the like for receiving and/or holding and/or retaining the appropriate items or goods thereon. The upper frame or form of the present invention thus may provide a spill containment function and/or a food/drink/etc. storage or holding or retaining function at or near or along the perimeter regions of the upper surface of the shelf panel, and optionally along other regions of the upper surface of the shelf panel as desired.

Figure 18:
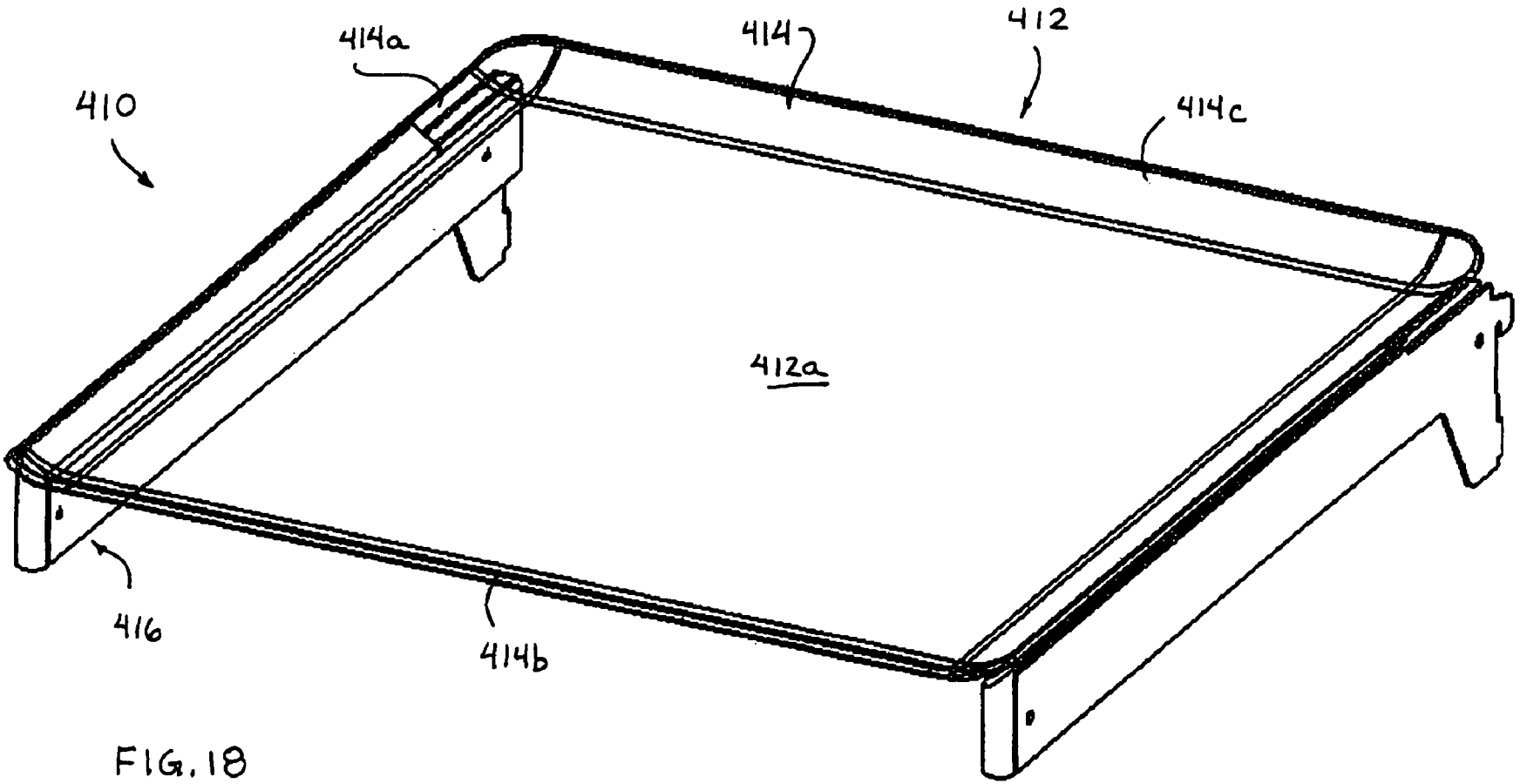
FIG. 18 is a perspective view of another shelf assembly of the present invention, with the shelf panel having all four perimeter edge portions turned upward to provide perimetal spill protection.

Optionally, and with reference to FIG. 18, a shelf assembly 410 includes a shelf panel 412 supported on support rails or slides or roller assemblies 416. The shelf panel 412 comprises a glass panel with a generally planar central or storage portion 412*a* and an upwardly turned or curved perimeter portion or spill prevention portion 414. The perimeter portion 414 includes opposite upwardly turned or curved side edge portions 414*a*, an upwardly turned or curved front edge portion 414*b* and an upwardly turned or curved rear edge portion 414*c*, so that the entire perimeter edge portion of the shelf panel is curved or bent upwardly to limit or substantially preclude spillage. The shelf panel thus may provide a substantially planar support portion and a four-sided integrated spill protection portion that circumscribes the circumference or entire perimeter of the substantially planar support portion of the shelf panel.

The shelf panel may comprise a tempered glass panel and may be substantially transparent or translucent so that a person may readily view items through the shelf panel or panels of a refrigerator. Optionally, the glass may comprise a thermally tempered glass or a chemically tempered glass, whereby the glass panel may be made with a reduced thickness of about one millimeter thick or thereabouts, while providing enhanced strength over other types of glass materials. The panel may be press bent or pressed against a form so as to form generally upwardly turned perimeter regions or edge portions to limit or substantially preclude spillage of liquids over the front, rear and/or sides of the shelf panel. For example, the shelf panel may be pressed upward against a substantially flat form (with curved perimeter edges) while the glass shelf panel is heated or at an elevated temperature, whereby the perimeter edge portions of the shelf panel are bent at the perimeter edges of the form. The shelf panel may then be lowered away from the form and cooled or quenched (such as air quenched) to form the shelf panel. The formed shelf panel may be substantially planar or flat at the central, support or storage region.

Optionally, the shelf panel may be formed via other forming techniques, such as glass molding or the like, to achieve the desired form. Optionally, anchor points or bumps or the like may be molded into the lower surface of the side edge portions of the molded shelf panel to provide anchor points for setting the bracket location. Optionally, a portion of the bracket may be molded with the shelf panel so as to provide an integrally or unitarily molded shelf panel and bracket portion. Desirably, the shelf panel comprises substantially clear or transparent glass, but may comprise a tinted glass or colored glass or a plastic material or the like, and may have a pattern or frit layer or the like screened or otherwise applied to the glass or plastic material.

Figure 23:
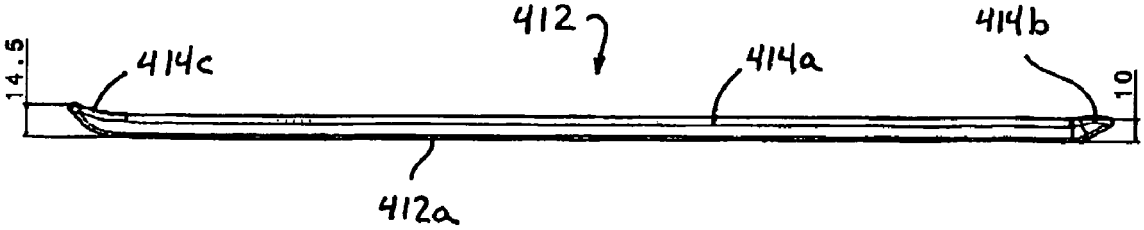
FIG. 23 is a side elevation of the shelf panel of FIGS. 20-22.
Figure 24:
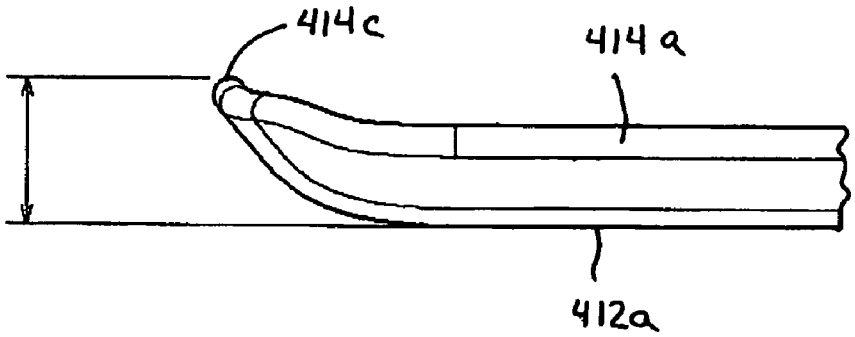
FIG. 24 is an enlarged sectional view of a rear portion of the shelf panel of the present invention.
Figure 25:
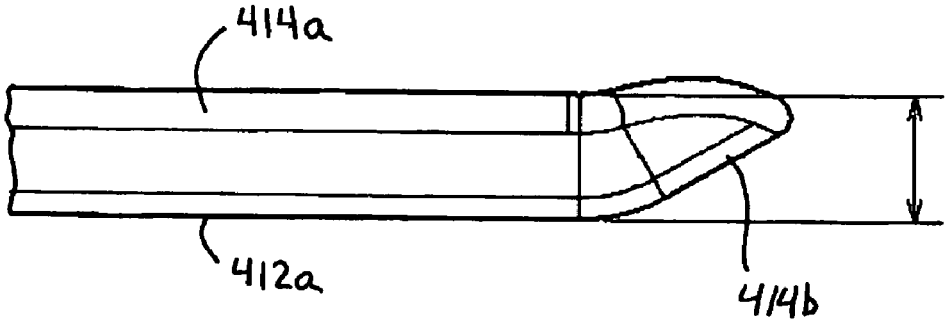
FIG. 25 is an enlarged sectional view of a front portion of the shelf panel of the present invention.
Figure 26:
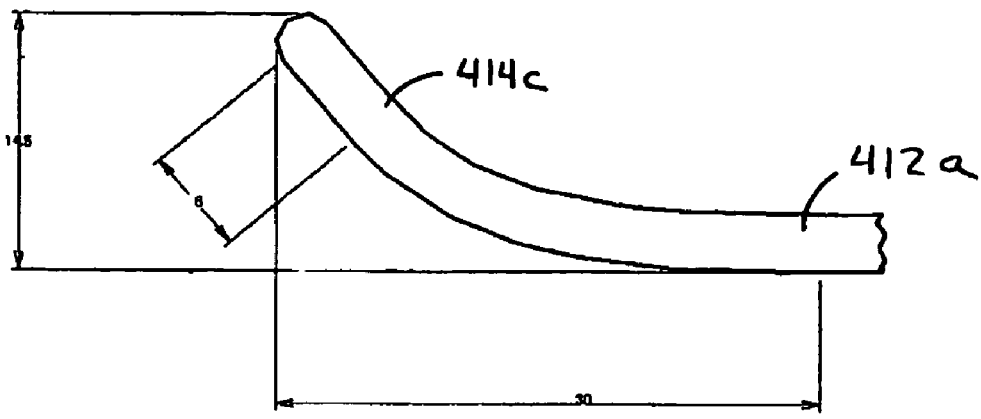
FIG. 26 is a sectional view of a rear portion of the shelf panel of the present invention.
Figure 27:
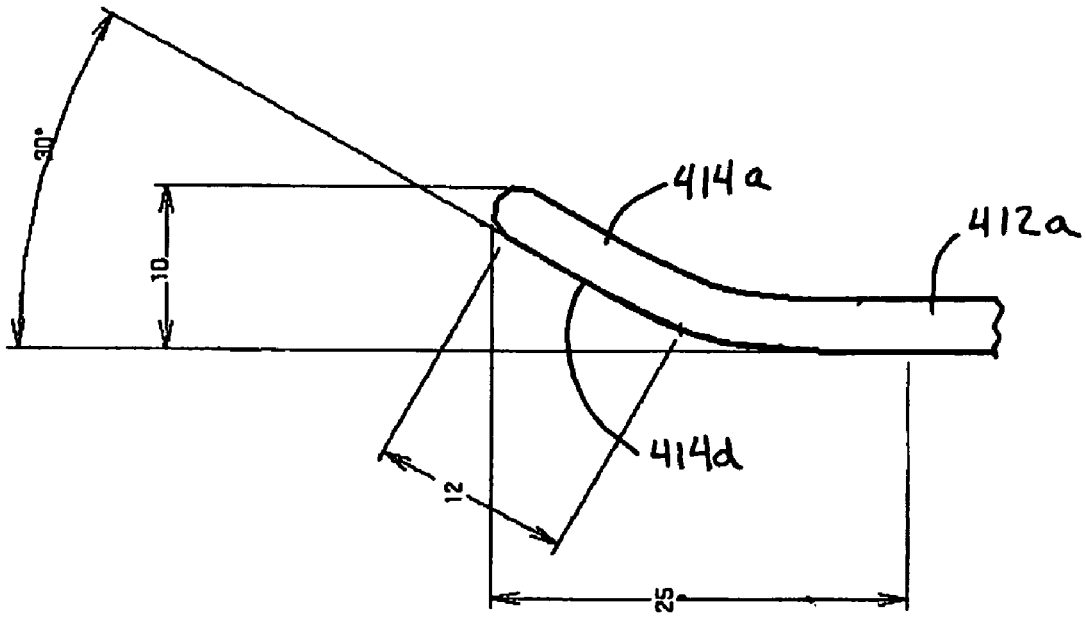
FIG. 27 is a sectional view of a side portion of the shelf panel of the present invention.

As shown in FIGS. 18 and 20-23, the front and side perimeter edge portions 414*b*, 414*a* of shelf panel 412 may protrude upwardly, such as, for example, about five to ten millimeters or thereabouts, while the rear perimeter edge portion 414*c* may protrude upwardly a greater amount, such as, for example, about ten to fifteen millimeters or thereabouts, in order to provide a greater lip or raised edge portion along the rear of the shelf panel to substantially preclude items from falling off the rear of the shelf panel. For example, and as shown in FIGS. 23, 24 and 26, the rear edge portion may be turned upwardly to provide a spill prevention lip that extends upward about 14.5 mm from a lower surface of the shelf panel, while FIGS. 23, 25 and 27 illustrate that the front edge portion 414*b* and/or the side edge portions 414*a* may be turned upwardly to provide a spill prevention lip that extends upward about 10 mm from the lower surface of the shelf panel. The shelf panel 412 and the edge portions 414*a*, 414*b*, 414*c* may be formed and sized to provide the desired generally planar shelf support area and desired spill limiting perimeter lip for the refrigerator shelf. For example, and as can be seen with reference to FIGS. 21 and 22, the shelf panel may have cross dimensions X, Y (FIG. 22) of about 435 mm by about 444 mm, with a generally planar support portion having cross dimensions X', Y' (FIG. 21) of about 402 mm by about 397 mm. Such a configuration thus may provide a substantially large generally planar support portion with a reduced amount of the overall shelf length and width dimensions being dedicated to the formation of the upwardly turned spill prevention portions.

Figure 19:
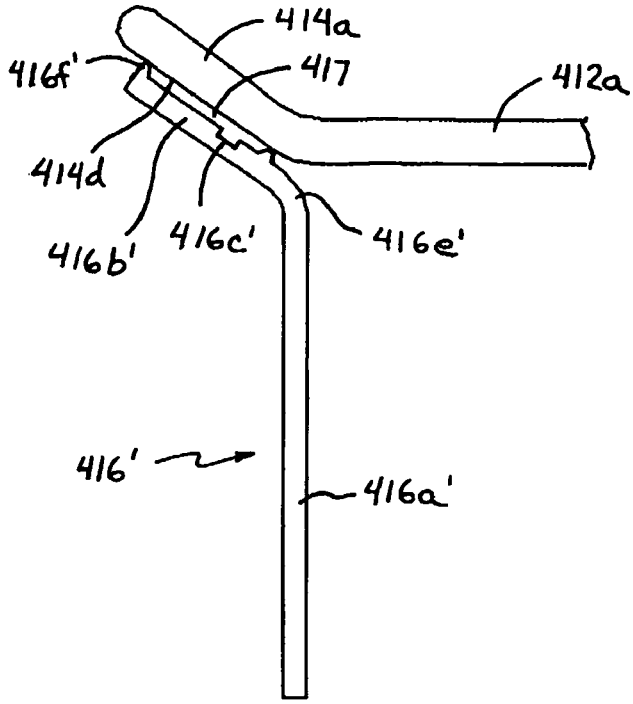
FIG. 19 is an end elevation of one of the support rails along a side edge portion of a shelf panel of the present invention.
Figure 20:
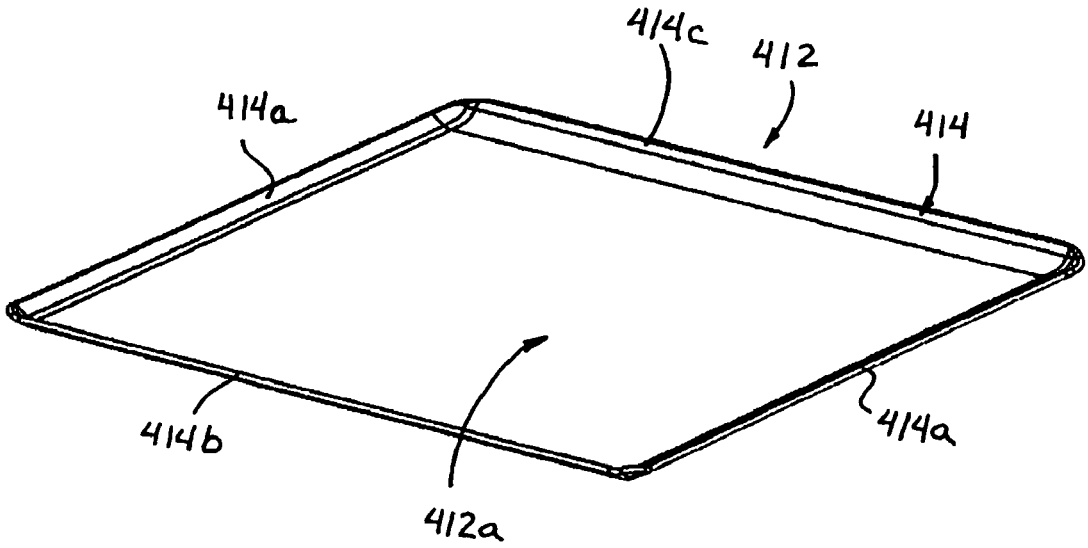
FIG. 20 is a perspective view of another refrigerator shelf panel in accordance with the present invention.
Figure 21:
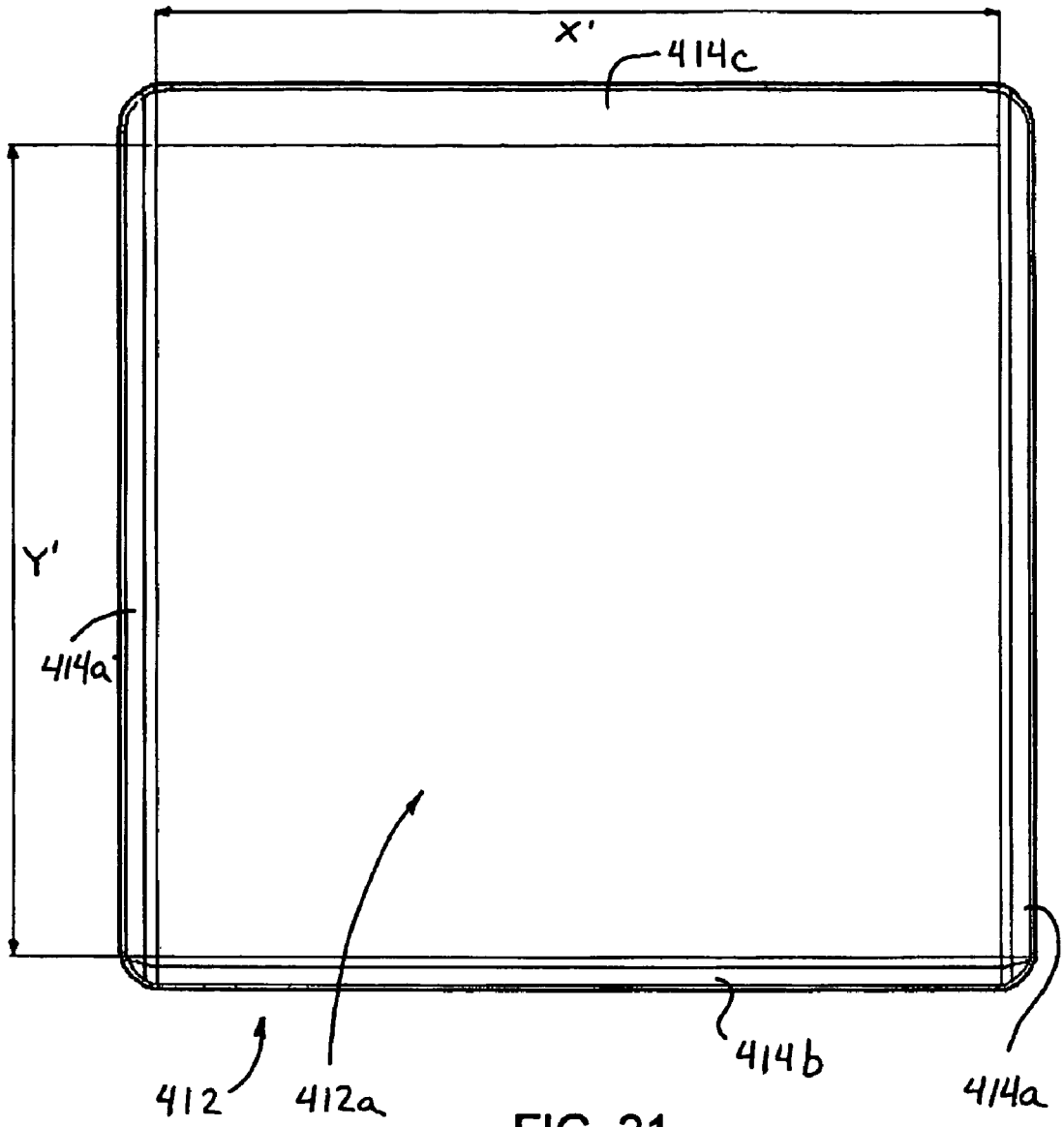
FIG. 21 is a plan view of the shelf panel of FIG. 20, showing planar shelf portion dimensions of an exemplary embodiment of the shelf panel.
Figure 22:
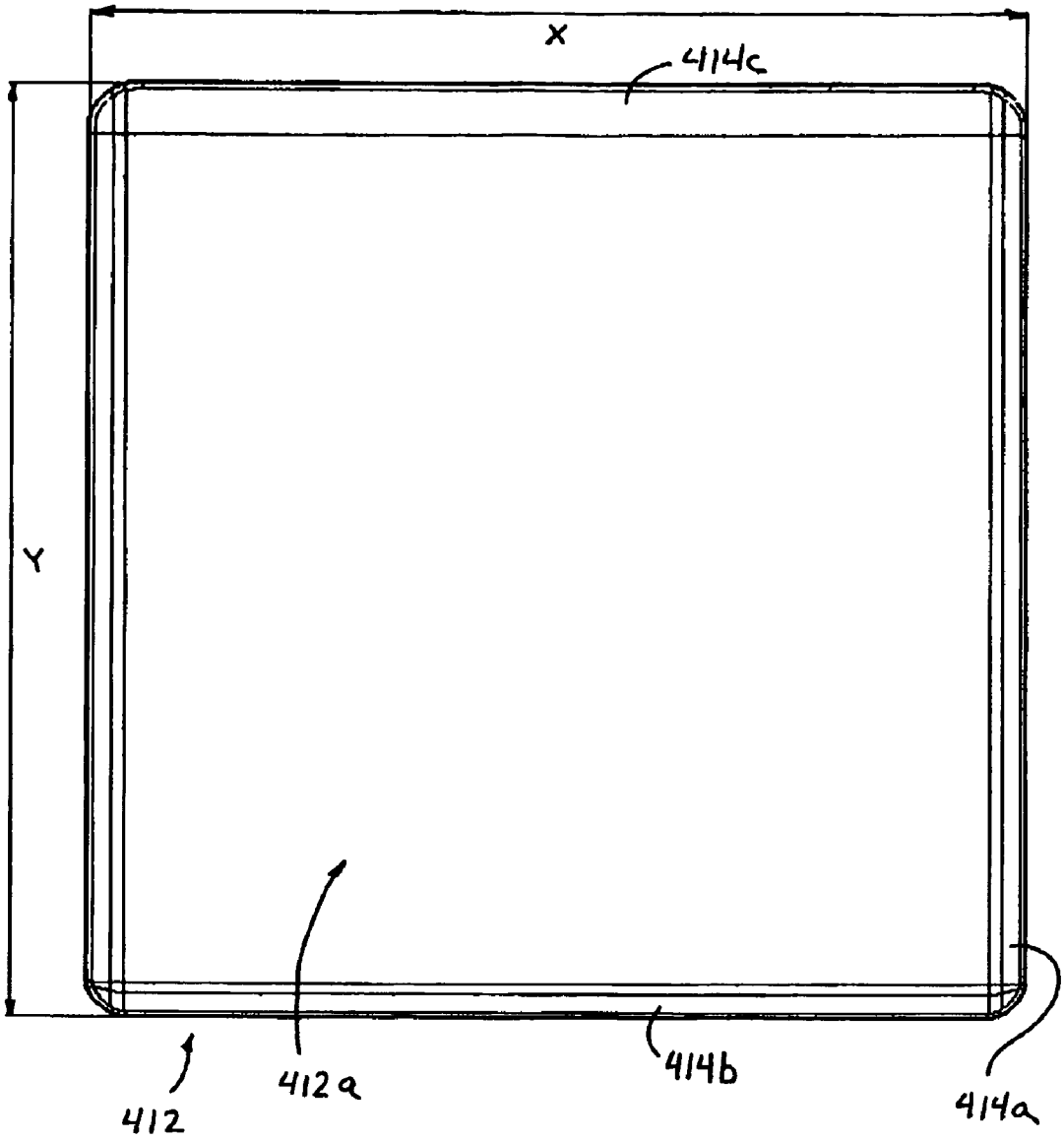
FIG. 22 is another plan view of the shelf panel of FIG. 20, showing exemplary dimensions of the shelf panel.

The shelf panel 412 is supported by a pair of opposite rails or support brackets 416. In the illustrated embodiment, and as can be seen in FIGS. 19 and 27, the side perimeter edge portions 414*a* are curved upwardly and provide a substantially planar attachment region 414*d* for attaching a substantially planar bracket attachment portion 416*b* of the support brackets 416 thereto, as discussed below. For example, and as shown in FIG. 27, the side edge portion 414*a* may have an upwardly turned angle of approximately 30 degrees (but could be formed at other angles, without affecting the scope of the present invention). The front edge portion and/or rear edge portion may have a similar upwardly turned angle, or may have a greater or lesser upward angle. For example, the front and side edge portions may have similar upward angles (such as about 30 degrees), while the rear edge portion is curved or bent or formed at a greater angle, such as, for example, about 60 degrees, without affecting the scope of the present invention. Such a difference in angles between the side edge portions 414*a* and the rear edge portion 414*c* can be seen with reference to FIGS. 26 and 27. The upward angle of the side edge portions may be selected to correspond to the upward angle of the angled attachment portion 416*b* of the support brackets, so that the support brackets substantially uniformly engage the side edge portions of the shelf panel, as can be seen in FIG. 19.

As shown in FIG. 26, the rear perimeter edge portion 414*c* may be curved or angled upwardly and may be curved upwardly from a location, for example, about 30 mm (or thereabouts) inward from the rear edge (which defines the rear perimeter edge region of the planar portion 412*a*). The rear perimeter edge portion 414*c* may curve upwardly at a desired angle and may provide a generally planar or flat region of about 6 mm or thereabouts at an upper portion of the rear edge portion 414*c*. Likewise, and as shown in FIG. 27, the side perimeter regions or portions 414*a* may curve upwardly from a side perimeter edge of the planar portion 412*a*, such as at a location, for example, about 25 mm (or thereabouts) inward from the outer edge of the shelf panel. The side perimeter regions 414*a* may curve upwardly and may provide the generally planar attachment portion or surface 414*d*, which may have a generally planar surface of, for example, about 12 mm wide or thereabouts along the length or substantially along the length of the side perimeter portions 414*a*.

Support brackets 416 may be similar to the brackets described above, and may include a generally vertical arm portion 416*a* and an angled attachment portion 416*b* for attaching or adhering to the attachment portion or surface 414*d* of the upwardly turned perimeter side edge portions 414*a* of shelf panel 412. In the illustrated embodiment of FIG. 18, brackets 416 are roller assemblies that include roller bearings such that the shelf panel may be substantially smoothly moved between a retracted position and an extended position to ease loading and unloading of items on the shelf. Although shown in FIG. 18 as a roller support assembly, the bracket may comprise a static bracket or a friction slider type bracket or a roller/slider type bracket, without affecting the scope of the present invention. For example, and as shown in FIG. 19, the bracket 416' may comprise a static bracket with a generally vertical arm portion 416*a*' and an angled attachment portion 416*b*', with the angled attachment portion 416*b*' angling upward and laterally outward (and angled at an angled or bent region or knee region 416*e*') to substantially coincide with the angle of the perimeter edge portions. Optionally, the bracket attachment portion may angle downwardly and inwardly, with the vertical arm portion at the outward portion of the bracket, or the bracket attachment portion may be generally horizontal and may extend laterally inward to attach to the lower surface of the generally planar support portion of the shelf panel, without affecting the scope of the present invention. Optionally, and, desirably, the mounting or bonding portions of the support rails or brackets may have bumps or raised portions or dimples or protrusions (such as protrusions 416*f* in FIG. 19) spaced along the angled attachment portion to set the desired or appropriate bond gap or bond layer thickness between the shelf panel surface and the mating surface of the supports or rails or brackets.

The brackets may comprise any suitable material, such as a metallic material, such as a powder coated metallic material (such as a white powder coat or a stainless steel looking powder coat or other coatings) or other metallic materials, such as stainless steel or the like, or may comprise a plastic or polymeric material, without affecting the scope of the present invention. Optionally, and particularly for slide out or roller bracket applications, the front portion of the shelf panel may include a handle portion formed or established thereon. For example, a handle portion or gripping or grasping element may be bonded to the front portion (such as to the lower surface of the planar support portion and/or of the upwardly turned front portion), to provide a means for a person to readily grasp the shelf panel to pull the shelf panel outward, such as for loading or unloading items at the shelf panel.

As can be seen in FIG. 19, attachment portion 416*b*' of bracket 416' is angled relative to arm portion 416*a*' to generally correspond with the planar attachment region 414*d* of side perimeter edge portions 414*a* of shelf panel 412. A bead of suitable adhesive 417 (such as discussed below) may be applied along the attachment portion of the bracket and/or along the attachment region of the side perimeter edge portion, and the bracket may then be pressed against the attachment region of the shelf panel to adhere or bond the bracket to the shelf panel. As also shown in FIG. 19, the attachment portion 416*b*' may include a channel or groove 416*c*' therealong that receives and retains excess adhesive when the bracket is pressed against the attachment region of the shelf and with a bead of adhesive therebetween.

The attachment portion 416*b* thus may be readily adhered to or bonded to the attachment region 414*d*, such as via a bead of adhesive or the like. Desirably, the adhesive may comprise a transparent adhesive, such as a transparent or substantially transparent epoxy or acrylate or the like. Optionally, the adhesive may comprise a UV curable adhesive, such as a UV curable acrylate or epoxy or a UV curable optically matching adhesive, such as the optical adhesives of the types commercially available from Norland Products of Cranbury, N.J., or other suitable transparent or substantially transparent adhesive. Such UV curable adhesives provide rapid curing or bonding of the glass shelf panel to the support bracket after the bracket is pressed against the attachment portion of the panel with the adhesive therebetween.

Preferably, the adhesive is selected to be at least partially to substantially space filling so that any tolerances or gaps between the attachment portion 416' of bracket 416' and the lower attachment region 414*d* of shelf panel 412 are filled in or taken up by the adhesive. Preferably, the adhesive is a clear or substantially transparent adhesive to limit viewability of the adhesive. Optionally, beads, such as index matching beads, such as glass beads or fibers or polymeric beads or fibers or the like, may be provided so that the adhesive has an enhanced space filling function between the bracket and the shelf panel.

Optionally, the attachment regions of the shelf panel may have a non-transparent coating or frit layer or paint or ink or the like disposed thereon, so as to substantially conceal the support bracket and limit viewing of the support bracket and adhesive through the shelf panel. The frit layer may be disposed or established on the underside of the shelf panel. However, because the lower surface of the shelf panel typically may pass over and contact rollers while the glass is still hot (during manufacturing of the shelf panel), it may be desirable to dispose or establish a frit or paint or ink layer or coating on the upper surface of the shelf panel and along the side attachment regions, while the support bracket is bonded or adhered to the lower uncoated glass surface of the shelf panel. Optionally, the frit or paint or ink layer or coating may be disposed or screened onto either the lower surface or upper surface of the shelf panel after forming the shelf panel. In applications where a non-transparent frit layer or other pattern or the like may be disposed at the attachment portion of the shelf panel, the adhesive may comprise a substantially non-transparent adhesive.

Therefore, the present invention provides a substantially transparent glass shelf panel that is bonded along the side regions of its lower surface to a pair of side shelf support brackets so as to avoid interference or intrusion onto the upper surface of the shelf panel. The shelf panel may be formed to have curvatures along one or more side or front or rear perimeter portions or regions, in order to provide the desired appearance and function, such as a spill proof function or handle function or the like, to the shelf panel. The shelf panel may include a frit layer along its lower surface and in the bonding area along the shelf support brackets to conceal the brackets so that they are not readily discernible and viewable through the substantially transparent glass shelf panel. The shelf panel may include an upper frame or form bonded to the upper surface of the shelf panel to provide a spill containment function and/or a storage or holding function at the upper surface of the shelf panel.

Changes and modifications to the specifically described embodiments can be carried out without departing from the principles of the present invention, which is intended to be limited only by the scope of the appended claims as interpreted according to the principles of patent law.

The embodiments of the invention in which an exclusive property of privilege is claimed are defined as follows:

1. A shelf assembly for use in a refrigerator, said shelf assembly comprising:

a shelf panel comprising a single glass panel;

said shelf panel comprising a generally planar glass shelf portion, a front perimeter bent glass region, a rear perimeter bent glass region and side perimeter bent glass regions;

said front perimeter bent glass region, said rear perimeter bent glass region and said side perimeter bent glass regions being upwardly angled relative to said generally planar glass shelf portion;

said upwardly angled side perimeter bent glass regions and said upwardly angled front and rear perimeter bent glass regions cooperating to provide a substantially continuous upwardly angled perimeter lip around said generally planar glass shelf portion;

said side perimeter bent glass regions having upwardly angled lower attachment surfaces;

a pair of support rails, each of said support rails having a generally vertical portion and an angled portion that extends at an angle from an upper edge region of said generally vertical portion, said angled portions of said support rails being angled to generally correspond to the angle of said upwardly angled side perimeter bent glass regions of said shelf panel, said angled portions of said support rails being bonded via a cured adhesive layer along said lower attachment surfaces of said side perimeter bent glass regions of said shelf panel; and wherein each of said support rails includes an attachment element at an end portion of said support rail that is proximate said rear perimeter bent glass region of said shelf panel, and wherein said attachment element is configured to attach to an attaching structure of a refrigerator to mount said shelf assembly at the refrigerator.

2. The shelf assembly of claim 1, wherein said shelf panel comprises strengthened glass.

3. The shelf assembly of claim 1, wherein said angled portions of said support rails include generally planar portions that are bonded to said lower attachment surfaces of said side perimeter bent glass regions of said shelf panel.

4. The shelf assembly of claim 3, wherein said angled portions of said support rails comprise curved portions.

5. The shelf assembly of claim 1, wherein each of said support rails comprises a slide mechanism.

6. The shelf assembly of claim 1, wherein each of said support rails comprises a fixed rail that is mountable in the refrigerator and a movable rail, and wherein said movable rails include said angled portions that are bonded to said lower attachment surfaces of said side perimeter bent glass regions of said shelf panel, said movable rails being movable along said fixed rails of said support rails to move said shelf panel relative to said fixed rails.

7. The shelf assembly of claim 6, wherein one of said fixed rail and said movable rail includes at least one roller and the other of said fixed rail and said movable rail defines a track therealong, said roller rolling along said track as said shelf panel moves relative to said fixed rail.

8. The shelf assembly of claim 1 including a frame portion bonded to an upper surface of said shelf panel.

9. The shelf assembly of claim 8, wherein said frame portion is bonded along at least one of said perimeter bent glass regions of said shelf panel.

10. The shelf assembly of claim 8, wherein said frame portion provides a storage function for holding at least one item.

11. The shelf assembly of claim 1 including a frit layer along said upwardly angled side perimeter bent glass regions of said shelf panel.

12. The shelf assembly of claim 1, wherein said shelf panel comprises tempered glass.

13. The shelf assembly of claim 1, wherein said shelf panel comprises thermally tempered glass.

14. The shelf assembly of claim 1, wherein said cured adhesive comprises a UV cured adhesive.

15. The shelf assembly of claim 14, wherein said UV cured adhesive comprises a substantially transparent UV cured adhesive.

16. The shelf assembly of claim 1, wherein said cured adhesive comprises a UV cured acrylate adhesive.

17. The shelf assembly of claim 1, wherein said shelf panel comprises a substantially clear glass shelf panel.

18. The shelf assembly of claim 17, wherein said support rails are viewable through said shelf panel when viewing said shelf panel from above said shelf assembly.

19. The shelf assembly of claim 1, wherein said support rails comprise coated metallic support rails.

20. The shelf assembly of claim 1, wherein said support rails comprise coated steel support rails.

21. The shelf assembly of claim 1, wherein said support rails comprise white coated metallic support rails.

22. The shelf assembly of claim 1, wherein said support rails comprise white powder coated metallic support rails.

23. The shelf assembly of claim 1, wherein said shelf panel comprises a bent glass panel that is formed via a heated glass substrate and a contoured form.

24. The shelf assembly of claim 1, wherein said shelf panel comprises a bent glass panel that is formed via urging a heated glass substrate against a contoured form so as to form said generally planar glass shelf portion and said upwardly angled front, rear and side perimeter bent glass regions.

25. The shelf assembly of claim 1, wherein said angled portions of said support rails include generally planar portions that are bonded to generally planar lower attachment surfaces of said side perimeter bent glass regions of said shelf panel.

26. The shelf assembly of claim 1, wherein said angled portions of said support rails are bonded to curved lower attachment surfaces of said side perimeter bent glass regions of said shelf panel.

27. The shelf assembly of claim 1, wherein said generally planar glass shelf portion comprises a storage portion of said shelf panel and said upwardly angled front, rear and side perimeter bent glass regions comprise a substantially spill proof portion of said shelf panel.

28. The shelf assembly of claim 1, wherein said support rails movably support said shelf panel such that said shelf panel is movable between an extended position and a retracted position.

29. The shelf assembly of claim 28 further comprising a handle element bonded to said front perimeter bent glass region.

30. A shelf assembly for use in a refrigerator, said shelf assembly comprising:

a shelf panel comprising a single tempered glass panel;

said shelf panel comprising a generally planar glass shelf portion, a front perimeter bent glass region, a rear perimeter bent glass region and side perimeter bent glass regions;

said front perimeter bent glass region, said rear perimeter bent glass region and said side perimeter bent glass regions being upwardly angled relative to said generally planar glass shelf portion;

said upwardly angled side perimeter bent glass regions and said upwardly angled front and rear perimeter bent glass regions cooperating to provide a substantially continuous upwardly angled perimeter lip around said generally planar glass shelf portion;

said side perimeter bent glass regions having upwardly angled lower attachment surfaces;

a pair of support rails, each of said support rails having a generally vertical portion and an angled portion that extends at an angle from an upper edge region of said generally vertical portion;

said angled portions of said support rails including generally planar portions and being angled to generally correspond to the angle of said upwardly angled side perimeter bent glass regions of said shelf panel, said generally planar portions of said angled portions of said support rails being bonded along said lower attachment surfaces of said side perimeter bent glass regions of said shelf panel via a cured adhesive layer; and wherein each of said support rails includes an attachment element at an end portion of said support rail that is proximate said rear perimeter bent glass region of said shelf panel, and wherein said attachment element is configured to attach to an attaching structure of a refrigerator to mount said shelf assembly at the refrigerator.

31. The shelf assembly of claim 30, wherein said generally planar portions include a plurality of protrusions to set a bond layer thickness of said cured adhesive layer between said support rails and said lower attachment surfaces of said shelf panel.

32. The shelf assembly of claim 30, wherein said glass shelf panel comprises a substantially transparent glass material, said cured adhesive layer comprising a substantially transparent material.

33. The shelf assembly of claim 32, wherein said cured adhesive layer comprises an optical index that generally corresponds with an optical index of said substantially transparent glass material.

34. The shelf assembly of claim 30, wherein said support rails movably support said shelf panel such that said shelf panel is movable between an extended position and a retracted position.

35. The shelf assembly of claim 34, wherein each of said support rails comprises a fixed rail that is mountable in the refrigerator and a movable rail, and wherein said movable rails include said angled portions that are bonded to said lower attachment surfaces of said side perimeter bent glass regions of said shelf panel, said movable rails being movable along said fixed rails of said support rails to move said shelf panel relative to said fixed rails and between said extended and retracted positions.

36. The shelf assembly of claim 34, wherein each of said support rails includes at least one roller for rolling engagement between a movable portion and a fixed portion of said support rail.

37. The shelf assembly of claim 34 further comprising a handle element bonded to said front perimeter bent glass region.

38. The shelf assembly of claim 30, wherein each of said support rails comprises a fixed support rail.

39. The shelf assembly of claim 30, wherein said cured adhesive comprises a UV cured adhesive.

40. The shelf assembly of claim 30, wherein said cured adhesive comprises a UV cured acrylate adhesive.

41. A shelf assembly for use in a refrigerator, said shelf assembly comprising:

a shelf panel comprising a single substantially transparent glass panel having a first optical index;

said shelf panel comprising a generally planar glass shelf portion, a front perimeter bent glass region, a rear perimeter bent glass region and side perimeter bent glass regions;

said front perimeter bent glass region, said rear perimeter bent glass region and said side perimeter bent glass regions being upwardly angled relative to said generally planar glass shelf portion;

said upwardly angled side perimeter bent glass regions and said upwardly angled front and rear perimeter bent glass regions cooperating to provide a substantially continuous upwardly angled perimeter lip around said generally planar glass shelf portion;

said side perimeter bent glass regions having upwardly angled lower attachment surfaces;

a pair of support rails, each of said support rails having a generally vertical portion and an angled portion that extends at an angle from an upper edge region of said generally vertical portion, said angled portions of said support rails being angled to generally correspond to the angle of said upwardly angled side perimeter bent glass regions of said shelf panel;

said angled portions of said support rails being bonded along said lower attachment surfaces of said side perimeter bent glass regions of said shelf panel via a cured adhesive layer, said cured adhesive layer having a second optical index, said first optical index substantially matching said second optical index; and wherein each of said support rails includes an attachment element at an end portion of said support rail that is proximate said rear perimeter bent glass region of said shelf panel, and wherein said attachment element is configured to attach to an attaching structure of a refrigerator to mount said shelf assembly at the refrigerator.

42. The shelf assembly of claim 41, wherein said angled portions of said support rails include generally planar portions that are bonded to said lower attachment surfaces of said side perimeter bent glass regions of said shelf panel.

43. The shelf assembly of claim 42, wherein said generally planar portions include a plurality of protrusions to set a bond layer thickness of said cured adhesive layer between said support rails and said lower attachment surfaces of said shelf panel.

44. The shelf assembly of claim 42 including spacing elements between said generally planar portions of said support rails and said lower attachment surfaces of said shelf panel, said spacing elements having a third optical index that substantially matches said first and second optical indexes.

45. The shelf assembly of claim 42, wherein said support rails include a plurality of protrusions extending from said generally planar portions to set a thickness of said adhesive layer between said generally planar portions of said support rails and said lower attachment surfaces of said shelf panel.

46. A shelf assembly for use in a refrigerator, said shelf assembly comprising:

a shelf panel comprising a single substantially transparent tempered glass panel;

said shelf panel comprising a generally planar glass shelf portion, a front perimeter bent glass region, a rear perimeter bent glass region and side perimeter bent glass regions;

said front perimeter bent glass region, said rear perimeter bent glass region and said side perimeter bent glass regions being upwardly angled relative to said generally planar glass shelf portion;

said upwardly angled side perimeter bent glass regions and said upwardly angled front and rear perimeter bent glass regions cooperating to provide a substantially continuous upwardly angled perimeter lip around said generally planar glass shelf portion;

each of said side perimeter bent glass regions having an upwardly angled lower attachment surface, said upwardly angled lower attachment surfaces comprising generally planar surfaces;

a pair of support rails, each of said support rails having a generally vertical portion and an angled portion that extends at an angle from an upper edge region of said generally vertical portion, said support rails comprising a coated metallic material;

said angled portions of said support rails including generally planar portions and being angled to generally correspond to the angle of said upwardly angled side perimeter bent glass regions of said shelf panel, said generally planar portions of said angled portions of said support rails being bonded along said generally planar lower attachment surfaces of said side perimeter bent glass regions of said shelf panel via a UV cured adhesive layer, said support rails being viewable through said shelf panel when viewing said shelf panel from above said shelf assembly; and wherein each of said support rails includes an attachment element at an end portion of said support rail that is proximate said rear perimeter bent glass region of said shelf panel, and wherein said attachment element is configured to attach to an attaching structure of a refrigerator to mount said shelf assembly at the refrigerator.

47. The shelf assembly of claim 46, wherein said support rails movably support said shelf panel such that said shelf panel is movable between an extended position and a retracted position.

48. The shelf assembly of claim 47, wherein each of said support rails comprises a fixed rail that is mountable in the refrigerator and a movable rail, and wherein said movable rails include said angled portions that are bonded to said lower attachment surfaces of said side perimeter bent glass regions of said shelf panel, said movable rails being movable along said fixed rails of said support rails to move said shelf panel relative to said fixed rails and between said extended and retracted positions.

49. The shelf assembly of claim 47, wherein each of said support rails includes at least one roller for rolling engagement between a movable portion and a fixed portion of said support rail.

50. The shelf assembly of claim 47 further comprising a handle element bonded to said front perimeter bent glass region.

51. The shelf assembly of claim 46, wherein each of said support rails comprises a fixed support rail.

52. The shelf assembly of claim 46, wherein said support rails comprise white coated metallic support rails.

53. The shelf assembly of claim 46, wherein said cured adhesive comprises a substantially transparent UV cured adhesive.

54. A shelf assembly for use in a refrigerator, said shelf assembly comprising:

a shelf panel comprising a glass material;

said shelf panel comprising a generally planar glass shelf portion, a front perimeter region, a rear perimeter region and side perimeter bent glass regions;

wherein said side perimeter bent glass regions are angled relative to said generally planar glass shelf portion;

said side perimeter bent glass regions having lower attachment surfaces;

a pair of support rails, each of said support rails having a generally vertical portion and an angled portion that extends at an angle from an upper edge region of said generally vertical portion, said angled portions of said support rails being angled to generally correspond to said lower attachment surfaces of said side perimeter bent glass regions of said shelf panel, said angled portions of said support rails being bonded via a cured adhesive layer along said lower attachment surfaces of said side perimeter bent glass regions of said shelf panel; and wherein each of said support rails includes an attachment element at an end portion of said support rail that is proximate said rear perimeter region of said shelf panel, and wherein said attachment element is configured to attach to an attaching structure of a refrigerator to mount said shelf assembly at the refrigerator.

55. The shelf assembly of claim 54, wherein said angled portions of said support rails include generally planar portions that are bonded to said lower attachment surfaces of said side perimeter bent glass regions of said shelf panel.

56. The shelf assembly of claim 54, wherein said angled portions of said support rails comprise curved portions.

57. The shelf assembly of claim 54, wherein said angled portions of said support rails include a plurality of protrusions extending therefrom to set a bond layer thickness of said cured adhesive layer between said angled portions of support rails and said lower attachment surfaces of said shelf panel.

58. The shelf assembly of claim 54, wherein said support rails movably support said shelf panel such that said shelf panel is movable between an extended position and a retracted position.

59. The shelf assembly of claim 58 further comprising a handle element bonded to said front perimeter region.

60. The shelf assembly of claim 58, wherein each of said support rails comprises a fixed rail that is mountable in the refrigerator and a movable rail, and wherein said movable rails include said angled portions that are bonded to said lower attachment surfaces of said side perimeter bent glass regions of said shelf panel, said movable rails being movable along said fixed rails of said support rails to move said shelf panel relative to said fixed rails.

61. The shelf assembly of claim 60, wherein one of said fixed rail and said movable rail includes at least one roller and the other of said fixed rail and said movable rail defines a track therealong, said roller rolling along said track as said shelf panel moves relative to said fixed rail.

62. The shelf assembly of claim 54 including a frame portion bonded to an upper surface and along at least one of said perimeter bent glass regions of said shelf panel, and wherein said frame portion provides a storage function for holding at least one item.

63. The shelf assembly of claim 54 including a frit layer along said side perimeter bent glass regions of said shelf panel.

64. The shelf assembly of claim 54, wherein said shelf panel comprises a substantially transparent glass material having a first optical index and said cured adhesive layer has a second optical index, said first optical index substantially matching said second optical index.

65. The shelf assembly of claim 64 including spacing elements between said angled portions of said support rails and said lower attachment surfaces of said shelf panel, said spacing elements having a third optical index that substantially matches said first and second optical indexes.

66. The shelf assembly of claim 54, wherein said shelf panel comprises tempered glass.

67. The shelf assembly of claim 54, wherein said cured adhesive comprises a UV cured adhesive.

68. The shelf assembly of claim 54, wherein said shelf panel comprises a substantially clear glass shelf panel, and wherein said UV cured adhesive comprises a substantially transparent UV cured adhesive, and wherein said support rails are viewable through said shelf panel when viewing said shelf panel from above said shelf assembly.

69. The shelf assembly of claim 54, wherein said support rails comprise coated metallic support rails.

70. The shelf assembly of claim 54, wherein said side perimeter bent glass regions comprise upwardly angled side perimeter bent glass regions and wherein said angled portions of said support rails comprise upwardly angled portions.

71. The shelf assembly of claim 70, wherein said front and rear perimeter regions comprise front and rear upwardly angled perimeter bent glass regions that are upwardly angled relative to said generally planar shelf portion.

72. A shelf assembly for use in a refrigerator, said shelf assembly comprising:

a shelf panel comprising a single substantially transparent tempered glass panel;

said shelf panel comprising a generally planar glass shelf portion, a front perimeter glass region, a rear perimeter glass region and side perimeter bent glass regions;

wherein said side perimeter bent glass regions are angled relative to said generally planar glass shelf portion;

each of said side perimeter bent glass regions having a lower attachment surface;

a pair of support rails, each of said support rails having a generally vertical portion and an angled portion that extends at an angle from an upper edge region of said generally vertical portion, said support rails comprising a coated metallic material;

wherein said support rails movably support said shelf panel such that said shelf panel is movable between an extended position and a retracted position, and wherein each of said support rails comprises a fixed rail that is mountable in the refrigerator and a movable rail, and wherein said movable rails include said angled portions that are bonded to said lower attachment surfaces of said side perimeter bent glass regions of said shelf panel, said movable rails being movable along said fixed rails of said support rails to move said shelf panel relative to said fixed rails and between said extended and retracted positions;

wherein said angled portions of said support rails are angled to generally correspond to said lower attachment surfaces of said side perimeter bent glass regions of said shelf panel, said angled portions of said support rails being bonded along said lower attachment surfaces of said side perimeter bent glass regions of said shelf panel via a UV cured adhesive layer, and wherein said support rails are viewable through said shelf panel when viewing said shelf panel from above said shelf assembly; and wherein each of said support rails includes an attachment element at an end portion of said support rail that is proximate said rear perimeter glass region of said shelf panel, and wherein said attachment element is configured to attach to an attaching structure of a refrigerator to mount said shelf assembly at the refrigerator.

73. The shelf assembly of claim 72, wherein at least one of said front and rear perimeter glass regions comprises a generally planar perimeter glass region that is generally coplanar with said generally planar glass shelf portion.

74. The shelf assembly of claim 72, wherein said front and rear perimeter regions comprise generally planar perimeter regions that are generally coplanar with said generally planar glass shelf portion.

75. The shelf assembly of claim 72, wherein said front and rear perimeter regions comprise front and rear upwardly angled perimeter bent glass regions that are upwardly angled relative to said generally planar glass shelf portion.

76. The shelf assembly of claim 72, wherein said side perimeter bent glass regions comprise upwardly angled side perimeter bent glass regions and wherein said angled portions of said support rails comprise upwardly angled portions that generally correspond to said upwardly angled side perimeter bent glass regions of said shelf panel.

77. The shelf assembly of claim 72, wherein said lower attachment surfaces comprise generally planar surfaces, and wherein said angled portions of said support rails comprise generally planar portions.

78. The shelf assembly of claim 72, wherein each of said support rails includes at least one roller for rolling engagement between a movable portion and a fixed portion of said support rail.

79. The shelf assembly of claim 72 further comprising a handle element bonded to said front perimeter region.

80. The shelf assembly of claim 72, wherein said cured adhesive comprises a substantially transparent UV cured adhesive.

* * * * *

UNITED STATES PATENT AND TRADEMARK OFFICE

CERTIFICATE OF CORRECTION

PATENT NO. : 8,262,177 B2
APPLICATION NO. : 11/577147
DATED : September 11, 2012
INVENTOR(S) : Alan D. Picken et al.

It is certified that error appears in the above-identified patent and that said Letters Patent is hereby corrected as shown below:

On the Cover Page:

(74) Attorney, Agent, or Firm:

"Gardner, Linn, Burkhart & Florey, LLP" should be --Gardner, Linn, Burkhart & Flory, LLP--

Column 1

Line 6, Insert --is a 371 national phase application of PCT Application No. PCT/US2005/036992, filed Oct. 13, 2005, which-- after "application"

Column 8

Line 20, "for" should be --or--

Column 12

Line 4, Delete "," after "and"

Column 13

Line 41, "of" should be --or--

Signed and Sealed this
Twenty-ninth Day of January, 2013

David J. Kappos

David J. Kappos
*Director of the United States Patent and Trademark Office*